US005878810A

United States Patent [19]

Saito et al.

[11] Patent Number: 5,878,810

[45] Date of Patent: Mar. 9, 1999

[54] AIR-CONDITIONING APPARATUS

[75] Inventors: Kazuo Saito, Fujisawa; Katuyoshi Kumazawa, Yamato; Tetsuo Sano, Fujinomiya; Toshihiko Saito, Tokyo; Yasuhiro Arai, Yokohama; Shinichi Kameyama, Kawaguchi, all of Japan

[73] Assignee: Kabushiki Kaisha Toshiba, Kawasaki, Japan

[21] Appl. No.: 351,036

[22] Filed: Nov. 28, 1994

Related U.S. Application Data

[63] Continuation-in-part of Ser. No. 797,959, Nov. 26, 1991, abandoned.

[30] Foreign Application Priority Data

Nov. 28, 1990 [JP] Japan ..... 2-322558
Nov. 28, 1990 [JP] Japan ..... 2-322559

[51] Int. Cl.[6] ..... F25B 29/00

[52] U.S. Cl. ..... 165/240; 62/160; 62/238.6; 62/238.7; 62/199; 62/510; 62/196.2; 237/2 B

[58] Field of Search ..... 165/29, 240; 62/160, 62/238.6, 238.7, 199, 510, 196.2; 237/2 B

[56] References Cited

U.S. PATENT DOCUMENTS

| | | | |
|---|---|---|---|
| 2,181,053 | 11/1939 | Hamilton | 165/43 |
| 3,859,814 | 1/1975 | Grant | 62/510 |
| 4,311,192 | 1/1982 | Vandervaart | 165/29 |
| 4,622,828 | 11/1986 | Fujiwara et al. | 62/510 |
| 5,050,233 | 9/1991 | Hitosugi et al. | 62/510 |
| 5,088,296 | 2/1992 | Hamaoka | 165/240 |

FOREIGN PATENT DOCUMENTS

| | | | |
|---|---|---|---|
| 0034155 | 3/1978 | Japan | 165/29 |
| 59-52164 | 3/1984 | Japan . | |
| 169273 | 7/1989 | Japan | 62/510 |
| 0300166 | 12/1989 | Japan | 165/29 |
| 186330 | 11/1963 | Sweden | 62/510 |
| 872336 | 7/1961 | United Kingdom | 62/510 |

*Primary Examiner*—John K. Ford
*Attorney, Agent, or Firm*—Foley & Lardner

[57] ABSTRACT

An air-conditioning apparatus forms a refrigerating cycle with a refrigerant heater and a compressor having two cylinders. The apparatus simultaneously carries out a refrigerant heating operation and a heat pump operation when a required heating capacity is high, and when the required heating capacity is low, only the heat pump operation. This operation technique helps reduce the size of the apparatus and expand a variable width of heating capacity. The apparatus also has a defrosting unit for defrosting an outdoor heat exchanger during the heat pump operation.

46 Claims, 22 Drawing Sheets

AIR-CONDITIONING APPARATUS

This application is a continuation of application Ser. No. 07/797,959, filed Nov. 26, 1991 now abandoned.

BACKGROUND OF THE INVENTION

1. Field of the Invention

The present invention relates to an air-conditioning apparatus employing a coolant or refrigerant heater (hereinafter referred to as refrigerant heater) in achieving a refrigerating cycle, and particularly to a refrigerant heating air-conditioning apparatus employing a two-cylinder compressor.

2. Description of the Prior Art

A heat pump air-conditioning apparatus usually forms a refrigerating cycle with a compressor, an indoor heat exchanger, an outdoor heat exchanger, and an expansion valve. During a heating operation, the indoor heat exchanger discharges heat out of coolant or refrigerant (hereinafter referred to as refrigerant), the expansion valve reduces the pressure of the refrigerant, and the outdoor heat exchanger lets the refrigerant absorb atmospheric heat and evaporate. The evaporated refrigerant is sent to the compressor.

In this way, the heat pump air-conditioning apparatus lets the refrigerant passing through the outdoor heat exchanger absorb atmospheric heat and evaporate. When an ambient temperature is low, the apparatus is required to provide a large heating capacity. The apparatus, however, cannot increase its capacity to meet this requirement because the refrigerant cannot absorb much heat from atmosphere when the ambient temperature is low.

To solve this problem, a refrigerant heating air-conditioning apparatus has been proposed. This apparatus employs a refrigerant heater in addition to a heat pump refrigerating cycle, to improve the heating capacity thereof. During a heating operation, this apparatus does not use an outdoor heat exchanger but directly heats and evaporates refrigerant with combustion heat. The apparatus discharges the latent heat of the evaporated refrigerant in an indoor heat exchanger to heat a room. During a cooling operation, the apparatus carries out a usual heat pump cooling operation.

Unlike the heat pump air-conditioning apparatus, the refrigerant heating air-conditioning apparatus does not let the refrigerant absorb atmospheric heat during the heating operation, and therefore, is not required to reduce the pressure of the refrigerant through an expansion valve.

FIG. 1 shows a Mollier diagram in which a continuous line indicates the condition of refrigerant during a heating cycle of the refrigerant heating air-conditioning apparatus, and a dotted line indicates the condition of refrigerant during a heating cycle of the standard heat pump air-conditioning apparatus. The refrigerant heating air-conditioning apparatus has no compression process seen in the heat pump air-conditioning apparatus, so that the compressor thereof serves as a refrigerant gas pump.

FIG. 2 shows a refrigerating cycle of the conventional refrigerant heating air-conditioning apparatus.

This apparatus mainly comprises a compressor 1, a four-way valve 3, an indoor heat exchanger 5, an expansion valve 7, a check valve 9, an outdoor heat exchanger 11, a refrigerant heater 13, and a two-way valve 15. These elements are connected to one another through piping.

During a heating operation, refrigerant is circulated sequentially through the compressor 1, four-way valve 3, indoor heat exchanger 5, expansion valve 7, two-way valve 15, refrigerant heater 13, and compressor 1. The expansion valve 7 is widely opened to substantially cause no pressure loss, and the outdoor heat exchanger 11 receive no refrigerant.

During a cooling operation, the refrigerant is circulated sequentially through the compressor 1, four-way valve 3, outdoor heat exchanger 11, check valve 9, expansion valve 7, indoor heat exchanger 5, four-way valve 3, and compressor 1. The two-way valve 15 is closed to supply no refrigerant to the refrigerant heater 13.

The heating capacity of this refrigerant heating air-conditioning apparatus is equal to the combustion capacity of a burner of the refrigerant heater 13 multiplied by the thermal efficiency of the refrigerant heater 13. Namely, the heating capacity of the apparatus cannot be adjusted beyond the capacity of the refrigerant heater 13. The capacity of the burner of the refrigerant heater 13 is usually adjustable at a ration of 1:3, i.e., at a minimum value of 1 to a maximum value of 3. Namely, the variable width of the heating capacity of this apparatus is 1:3.

When a required heating load is small, the variable width of the heating capacity must be supplemented by an ON/OFF operation, which deteriorates a comfortable heating condition. Compared with a continuous operation, the ON/OFF operation is disadvantageous in terms of a running cost and the durability of the burner. In particular, the ON/OFF operation causes combustion gases to condense in a heat exchanger of the refrigerant heater 13 and corrode the heat exchanger due to high acidity of the combustion gases.

To avoid the ON/OFF operation and achieve continuous heating, the air-conditioning apparatus must have a variable width of capacity of about 1:10.

When the heating operation is continued for a long time, the refrigerant gradually leaks into the outdoor heat exchanger 11 which is not in use during the heating operation, and stays therein under a liquefied state. This may cause a shortage of the refrigerant in the heating cycle. To avoid the shortage, the heating operation must be stopped to collect the leaked refrigerant. In addition, the refrigerant must be collected at the start of the heating operation. This may elongate a start-up time of the heating operation.

Since the refrigerant heater 13 is solely used without the outdoor heat exchanger 11 during the heating operation, the refrigerant heater 13 must have a larger capacity than in the simultaneous use of the refrigerant heater 13 and outdoor heat exchanger 11. This ineffective use of the outdoor heat exchanger 11 increases the size of the equipment.

When the refrigerant heater 13 uses kerosene as a fuel, the kerosene is stored in a tank, and when the kerosene in the tank is completely consumed, the heating operation is naturally stopped.

When the outdoor heat exchanger 11 is used as a heat pump for carrying out the heating operation, the outdoor heat exchanger 11 may be frosted depending on ambient conditions. In this case, the outdoor heat exchanger 11 must be defrosted by directly supplying high-temperature gasified refrigerant from the compressor 1 to the outdoor heat exchanger 11 through the four-way valve 3. Then, the high-temperature gasified refrigerant is not supplied to the indoor heat exchanger 5. Namely, the heating operation must be temporarily stopped during the defrosting operation, and therefore, a user may not feel comfortable warmth during this period.

When operated in a cold district, the heat pump operation and refrigerant heating operation may be simultaneously carried out. In this case, the quantity of heat supplied to the indoor heat exchanger by the refrigerant heating operation is approximately four times larger than that by the heat pump operation. Accordingly, in a conventional two compressor system, the quantity of refrigerant discharged from a compressor for the heat pump operation is smaller than that from a compressor for the refrigerant heating operation. Since lubricant is evenly contained in the refrigerant fed to the compressors, the compressor for the heat pump operation with a smaller discharge of refrigerant may hold the refrigerant and lubricant, while the compressor for the refrigerant heating operation with a larger discharge of refrigerant may cause a shortage of the refrigerant and lubricant.

SUMMARY OF THE INVENTION

To solve these problems of the prior art, an object of the invention is to provide an air-conditioning apparatus employing a combination of a refrigerant heating method and a heat pump method, to achieve a wide variable width of heating capacity for sufficiently covering a low range of heating load.

Another object of the invention is to provide an air-conditioning apparatus that can be continuously operated without stopping a heating operation during defrosting.

In order to accomplish the objects, a first aspect of the present invention provides an air-conditioning apparatus comprising a, compressor having two suction ports, a discharge port, and two simultaneously operating cylinders corresponding to the two suction ports; an indoor heat exchanger; an outdoor heat exchanger; a directional control valve for connecting the indoor and outdoor heat exchangers with the discharge port and one of the suction ports of the compressor; an expansion valve disposed in piping for connecting the indoor heat exchanger with the outdoor heat exchanger; a refrigerant heater disposed between the piping and the other suction port of the compressor; and an open/close valve means disposed between the refrigerant heater and the piping.

According to this arrangement, the open/close valve means is opened when a required heating capacity is high. In this case, refrigerant flows through both the refrigerant heater and outdoor heat exchanger, to simultaneously achieve a refrigerant heating operation and a heat pump operation. When the required heating capacity is low, the open/close valve means is closed. Then, the refrigerant does not flow through the refrigerant heater but flows only through the outdoor heat exchanger to achieve only the heat pump operation. This arrangement expands a variable width of heating capacity of the apparatus. The two-cylinder compressor system employed in this arrangement is compact, inexpensive, and well-balanced, has a small demand of electricity, causes little vibration and noise, and does not hold lubricant.

A second aspect of the invention provides an air-conditioning apparatus comprising a compressor having two suction ports, a discharge port, and two simultaneously operating cylinders corresponding to the two suction ports; an indoor heat exchanger; an outdoor heat exchanger; a directional control valve for connecting the indoor and outdoor heat exchangers with the discharge port and one of the suction ports of the compressor; an expansion valve disposed in piping for connecting the indoor heat exchanger with the outdoor heat exchanger; a refrigerant heater disposed between an intermediate position in the piping between the expansion valve and the indoor heat exchanger and the other suction port of the compressor; an open/close valve means disposed between the refrigerant heater and the piping; a flow control valve disposed between a connection of the open/close valve means to the piping and the indoor heat exchanger; and a bypassing open/close valve means disposed in parallel with the expansion valve.

With this arrangement, a refrigerant heating operation and a heat pump operation are simultaneously carried out when a required heating capacity is high. In this case, the open/close valve means is opened, while the bypassing open/close valve arrangement in parallel with the expansion valve is closed. At this time, the flow control valve mainly adjusts the flow rate of refrigerant to the refrigerant heater. On the other hand, when the required heating capacity is low or when a cooling operation is required, only the heat pump operation is carried out. In this case, the open/close valve means is closed, the bypassing open/close valve opened, and the opening of the flow control valve is contracted. At this time, the flow control valve serves as an expansion valve. In this way, the different expansion valves are used for the two operating conditions, to deal with different refrigerant flow rates. This stabilizes an air-conditioning cycle and realizes a wide variable width of capacity.

A third aspect of the invention provides an air-conditioning apparatus comprising a compressor having two suction ports, a discharge port, and two simultaneously operating cylinders corresponding to the two suction ports; an indoor heat exchanger; an outdoor heat exchanger; a directional control valve for connecting the indoor and outdoor heat exchangers with the discharge port and one of the suction ports of the compressor; an expansion valve disposed in piping for connecting the indoor heat exchanger with the outdoor heat exchanger; a refrigerant heater disposed between the piping and the other suction port of the compressor; a first open/close valve means disposed between the refrigerant heater and the piping; and a second open/close valve means disposed between two piping systems connected to the two suction ports, respectively.

With this arrangement, the first open/close valve means is opened while the second open/close valve means is closed when a required heating capacity is high. In this case, refrigerant flows through both the refrigerant heater and outdoor heat exchanger, to simultaneously achieve a refrigerant heating operation and a heat pump operation. On the other hand, when the required heating capacity is low, the first and second open/close valve means are both closed. In this case, the refrigerant does not flow to the refrigerant heater but flows to the outdoor heat exchanger to achieve the heat pump operation in which the refrigerant is sucked through one of the suction ports of the compressor. This realizes a very wide variable width of capacity that sufficient covers a low heating load.

A fourth aspect of the invention provides an air-conditioning apparatus comprising a compressor having two suction ports, a discharge port, and two simultaneously operating cylinders corresponding to the two suction ports; an indoor heat exchanger; an outdoor heat exchanger; a directional control valve for connecting the indoor and outdoor heat exchangers with the discharge port and one of the suction ports of the compressor; an expansion valve disposed in piping for connecting the indoor heat exchanger with the outdoor heat exchanger; a refrigerant heater disposed between the piping and the other suction port of the compressor; a first open/close valve means disposed between the refrigerant heater and the piping; and a second open/close valve means disposed in bypass piping for connecting piping connected to the other suction port with the piping connected to the expansion valve side of the outdoor heat exchanger.

With this arrangement, a heating operation is carried out by opening the first open/close valve means. In this case, refrigerant exiting from the indoor heat exchanger flows through both the refrigerant heater and outdoor heat exchanger, to simultaneously achieve a refrigerant heating operation and a heat pump operation. When the first open/close valve means is closed during the heating operation, the refrigerant exiting from the indoor heat exchanger does not flow to the refrigerant heater but flows to the outdoor heat exchanger, to achieve only the heat pump operation. When the outdoor heat exchanger is frosted during the heat pump operation, the second open/close valve means is opened, and if the heat pump operation is solely carried out, the first open/close valve means is also opened. As a result, evaporated refrigerant of high temperature exiting from the refrigerant heater passes through the bypass piping in which the opened second open/close valve means is disposed, to reach and defrost the outdoor heat exchanger. For the defrosting operation, only the second open/close valve means is opened, and the directional control valve is not operated so that the heating operation may be continued.

A fifth aspect of the invention provides an air-conditioning apparatus comprising a compressor having two suction ports, a discharge port, and two simultaneously operating cylinders corresponding to the two discharge ports; an indoor heat exchanger; an outdoor heat exchanger; a directional control valve for connecting the indoor and outdoor heat exchangers with the discharge port and one of the suction ports of the compressor; an expansion valve disposed in piping for connecting the indoor heat exchanger with the outdoor heat exchanger; a refrigerant heater disposed between the piping and the other suction port of the compressor; a first open/close valve means disposed between the refrigerant and heater and the piping; and a second open/close valve means disposed in bypass piping for connecting piping connected to the discharge port of the compressor with the piping connected to the expansion valve side of the outdoor heat exchanger.

With this arrangement, the first open/close valve means is opened during a heating operation. In this case, refrigerant exiting from the indoor heat exchanger flows through both the refrigerant heater and outdoor heat exchanger, to simultaneously achieve a refrigerant heating operation and a heat pump operation. When the first open/close valve means is closed during the heating operation, the refrigerant exiting from the indoor heat exchanger does not flow to the refrigerant heater but flows to the outdoor heat exchanger to achieve only the heat pump operation. When the outdoor heat exchanger is frosted during the heat pump operation, the second open/close valve means is opened, so that evaporated refrigerant of high temperature exiting from the compressor passes through the bypass piping in which the opened second pen/close valve means is disposed, to reach and defrost the outdoor heat exchanger. This defrosting is achieved only by opening the second open/close valve means. Since the directional control valve is not operated at this time, the heating operation is continued.

A sixth aspect of the invention provides an air-conditioning apparatus comprising a compressor having two suction ports, a discharge port, and two simultaneously operating cylinders corresponding to the two suction ports; an indoor heat exchanger; an outdoor heat exchanger; a directional control valve for connecting the indoor and outdoor heat exchangers with the discharge port and one of the suction ports of the compressor; an expansion valve disposed in piping for connecting the indoor heat exchanger with the outdoor heat exchanger; a refrigerant heater disposed between an intermediate portion in the piping between the indoor heat exchanger and the expansion valve and the other suction port; a first open/close valve means disposed between the refrigerant heater and the piping; and a second open/close valve means and heat accumulating means disposed in bypass piping for bypassing the expansion valve.

With this arrangement, the first open/close valve means is opened during a heating operation. In this case, refrigerant exiting from the indoor heat exchanger passes through both the refrigerant heater and outdoor heat exchanger, to simultaneously achieve a refrigerant heating operation and a heat pump operation. When the first open/close valve means is closed during the heating operation, the refrigerant exiting from the indoor heat exchanger does not flow to the refrigerant heater but flows to the outdoor heat exchanger, to achieve only the heat pump operation. When the outdoor heat exchanger is frosted during the heat pump operation, the second open/close valve means is opened, so that the refrigerant exiting from the indoor heat exchanger passes through the bypass piping in which the second open/close valve means is disposed, and through the heat accumulating means. As a result, the refrigerant becomes a high-temperature gas, which passes through the outdoor heat exchanger to defrost the same. This defrosting process is carried out only by opening the second open/close valve means without operating the directional control valve. Accordingly, the heating operation is continued.

These and other objects, features and advantages of the present invention will be more apparent from the following detailed description of preferred embodiments in conjunction with the accompanying drawings.

DETAILED DESCRIPTION OF THE EMBODIMENTS

Embodiments of the invention will be explained with reference to the drawings.

Figure 1:
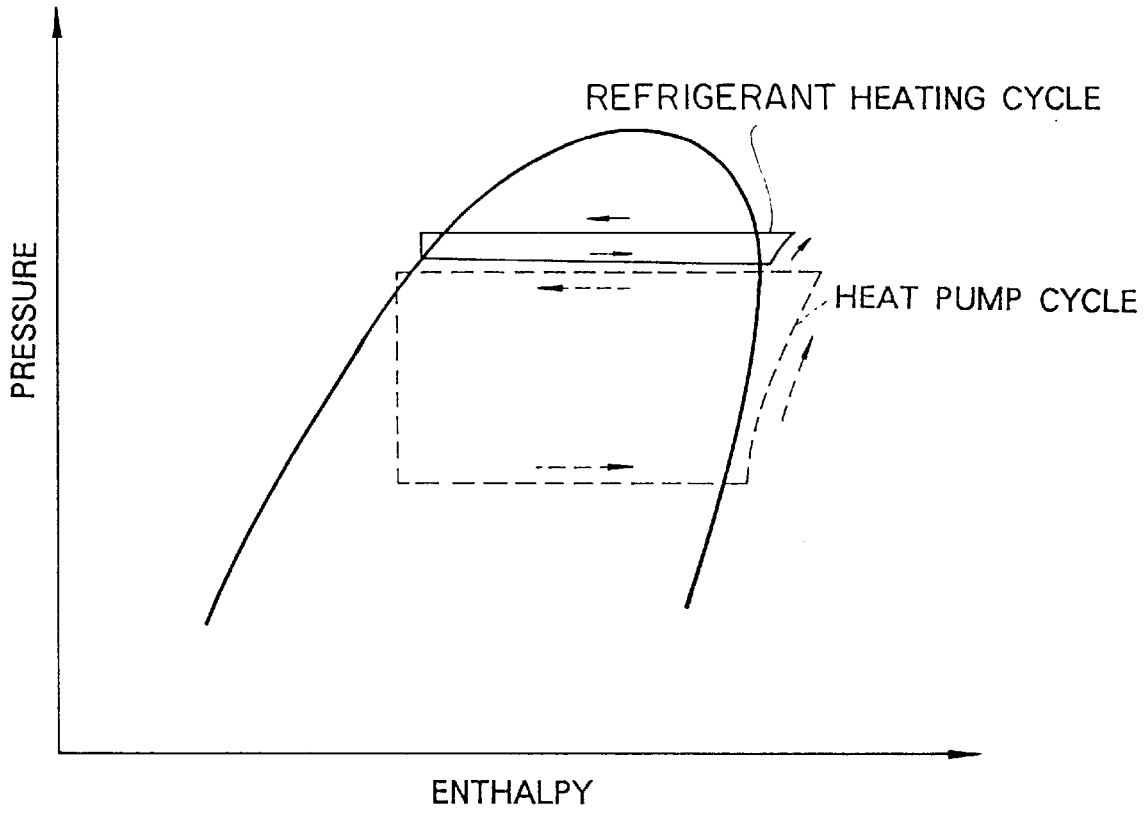
FIG. 1 PRIOR ART
FIG. 1 is a Mollier chart showing a refrigerating cycle of a refrigerant heating air-conditioning apparatus according to a prior art.
Figure 2:
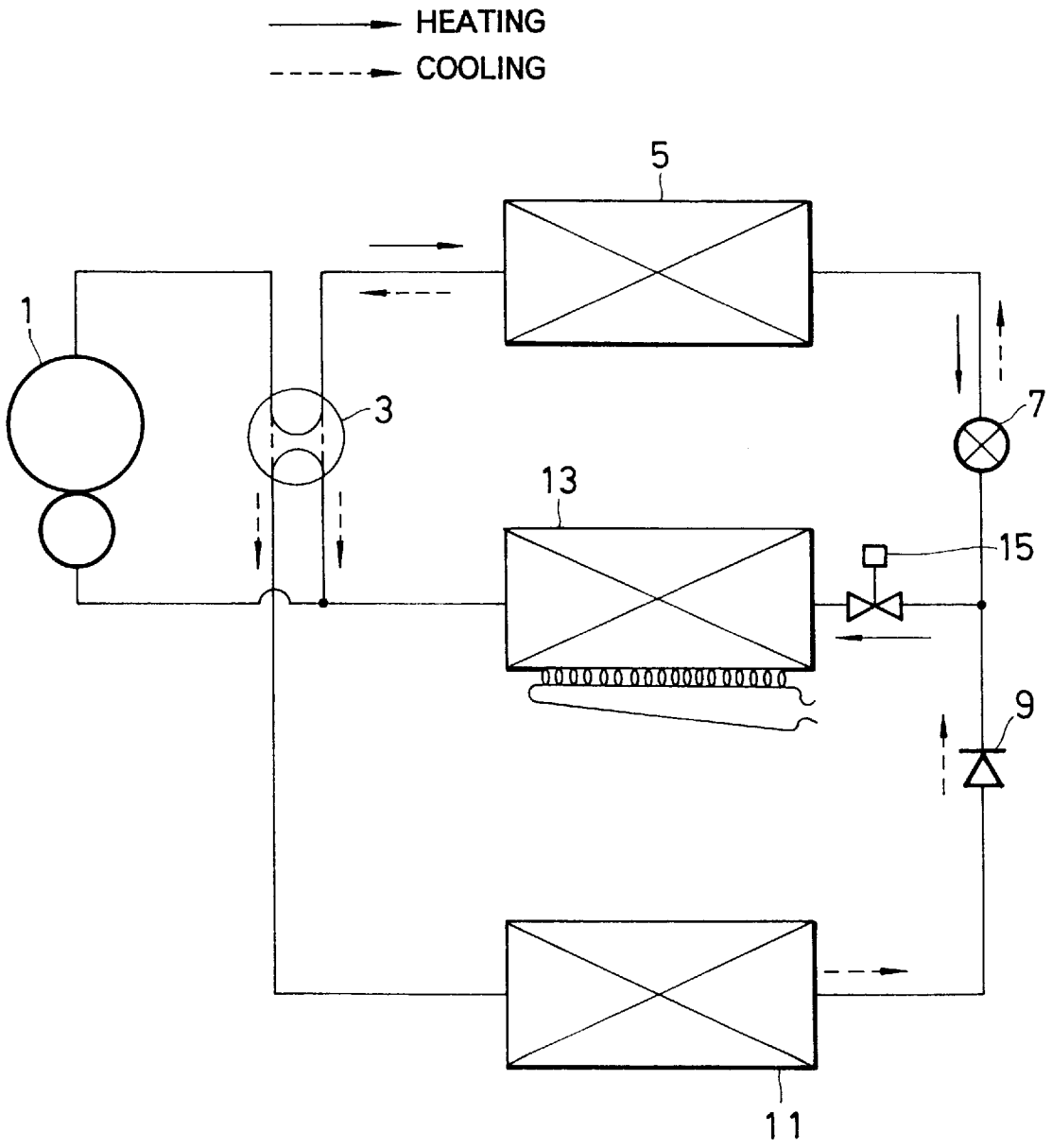
FIG. 2 PRIOR ART
FIG. 2 is a schematic view showing a refrigerating cycle of the air-conditioning apparatus according to the prior art.
Figure 3:
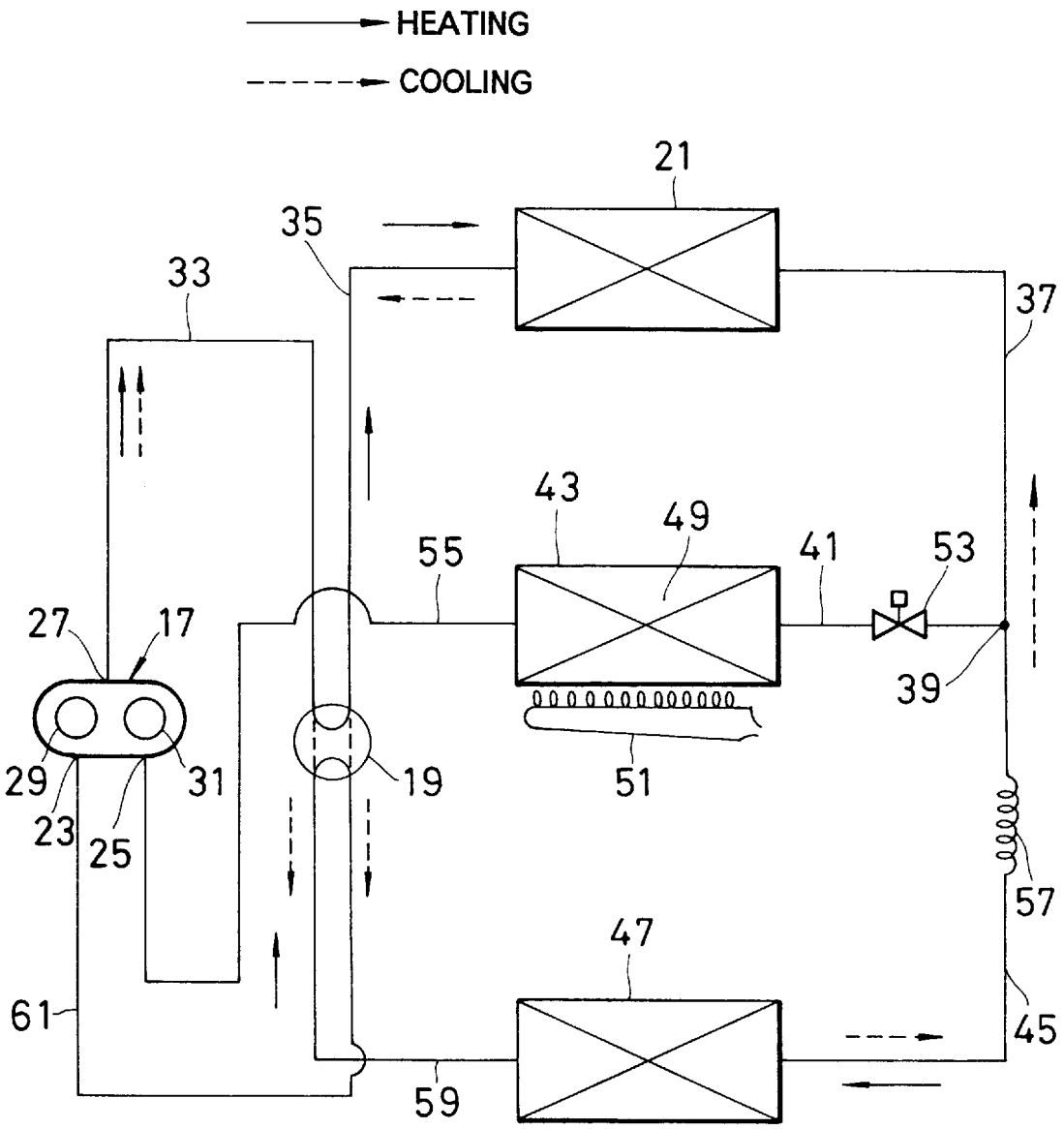
FIG. 3 is a schematic view showing a refrigerating cycle of a refrigerant heating air-conditioning apparatus according to a first embodiment of the invention.

FIG. 3 is a schematic view showing a refrigerating cycle of an air-conditioning apparatus according to the first embodiment of the invention.

The air-conditioning apparatus comprises, in refrigerant flowing order during a heating operation, a two-cylinder compressor 17, a four-way valve 19 serving as a directional control valve, and an indoor heat exchanger 21. The two-cylinder compressor 17 has two suction ports 23 and 25, a discharge port 27, and first and second cylinders 29 and 31 corresponding to the two suction ports 23 and 25, respectively. The first and second cylinders 29 and 31 are simultaneously driven. The discharge port 27 of the compressor 17 is connected to the four-way valve 19 through piping 33. The four-way valve 19 is connected to the indoor heat exchanger 21 through piping 35.

Refrigerant from the indoor heat exchanger 21 is passed through piping 37 and divided into two flows through a branch 39. One of the two flows is guided toward a refrigerant heater 43 through piping 41, and the other flow toward an outdoor heat exchanger 47 through piping 45.

The refrigerant heater 43 comprises a refrigerant heater heat exchanger 49 and a burner 51.

A two-way valve 53 serving as an open/close valve is disposed in the upstream piping 41 to the refrigerant heater 43. The two-way valve 53 closes the refrigerant path to the refrigerant heater 43 during a heating operation carried out only with a heat pump operation of the outdoor heat exchanger 47 without using the refrigerant heater 43, or during a cooling operation that does not require the refrigerant heater 43.

The refrigerant exiting from the refrigerant heater 43 flows through piping 55, which is connected to the suction port 25 corresponding to the second cylinder 31 of the two-cylinder compressor 17.

An expansion valve 57 is disposed in the piping 45 between the branch 39 and the outdoor heat exchanger 47. The expansion valve 57 decreases the pressure of the refrigerant so that the refrigerant can absorb atmospheric heat during the heat pump operation. The expansion valve 57 may be formed from a capillary tube.

The refrigerant exiting from the outdoor heat exchanger 47 flows to the two-cylinder compressor 17 through the four-way valve 19. The outdoor heat exchanger 47 is connected to the four-way valve 19 through piping 59. The four-way valve 19 is connected to the suction port 23 corresponding to the first cylinder 29 of the compressor 17 through piping 61.

When a required heating capacity is large, the refrigerant heating operation and heat pump operation are simultaneously carried out. In this case, the two-way valve 53 is opened.

Figure 4:
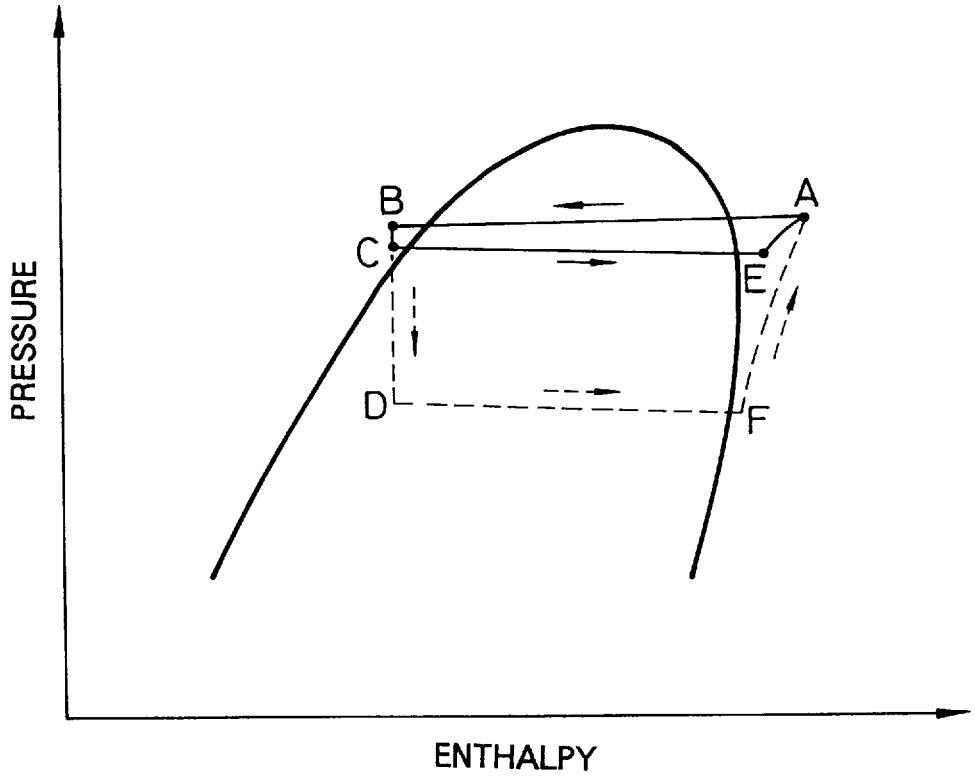
FIG. 4 is a Mollier chart showing the first embodiment of FIG. 3.

FIG. 4 is a Mollier chart showing the condition of the refrigerant under these operations. In the Mollier chart, the compressor 17 compresses the refrigerant at A, the indoor heat exchanger 21 discharges heat out of the refrigerant during a period of from A to B, the two-way valve 53 reduces the pressure of the refrigerant during a period of from B to C, the refrigerant heater 43 lets the refrigerant absorb heat during a period of from C to E, and the second cylinder 31 of the compressor 17 compresses the refrigerant during a period of from E to A.

In the refrigerant heater 43, the temperature of a combustion gas is so large there is no need to reduce the pressure of the refrigerant for absorbing heat. Accordingly, a segment from A to B representing the heat discharging process on the Mollier chart is close to a segment from C to E representing the heat absorbing process.

The refrigerant absorbs atmospheric heat in the outdoor heat exchanger 47 during a period of from D to F, and compressed in the first cylinder 29 of the compressor 17 during a period of from F to A. This is the heat pump operation for absorbing the atmospheric heat. In this heat pump operation, the segment from A to B representing the heat discharging process on the Mollier chart is spaced widely apart from a segment from D to F representing the heat absorbing process.

In this way, for providing a large heating capacity, the refrigerant absorbs heat not only in the refrigerant heater 43 but also in the outdoor heat exchanger 47. With this simultaneous heat absorption of the refrigerant from the two heat sources, the outdoor heat exchanger 47 is effectively utilized. Compared with solely operating the refrigerant heater 43, the cooperative operation of the refrigerant heater 43 and heat pump (outdoor heat exchanger 47) can reduce the size of the refrigerant heater 43 for a portion of heat provided by the heat pump. As a result, the total size of the apparatus can be reduced.

When the required heating capacity is small, the two-way valve 53 is closed to stop the refrigerant heater 43, and only the heat pump operation with the outdoor heat exchanger 47 is carried out. As a result, a variable width of capacity for covering the low capacity heating operation is extended more than that achieved by the single operation of the refrigerant heater 43. Also, an overall variable width of heating capacity of the air-conditioning apparatus is also expanded.

With this extended variable width for covering the low capacity heating operation, the refrigerant heater 43 is not required to be repeatedly turned ON and OFF even when a required heating load is small. As a result, a user may feel comfortable warmth. Since the refrigerant heater 43 can be continuously operated, a running cost may be reduced compared with the ON/OFF operation. Unlike the ON/OFF operation, the continuous operation does not deteriorate the durability of the burner 51, or condense combustion gases in the heat exchanger 49 of the refrigerant heater 43 to corrode the heat exchanger 49 due to high acidity of the condensed combustion gases.

When the air-conditioning apparatus is operated at a low heating capacity, the two-way valve 53 is closed. During this period, the cylinders 29 and 31 of the compressor 17 are simultaneously driven, so that the heat exchanger 49 of the refrigerant heater 43 is substantially vacuumed by the second cylinder 31 of the compressor 17. No refrigerant may be condensed and held, therefore, in the heat exchanger 49. Since the outdoor heat exchanger 47 is always used, there is also no risk of holding the refrigerant in the outdoor heat exchanger 47.

Since no refrigerant is held in the heat exchanger 49 and outdoor heat exchanger 47, no shortage of the refrigerant occurs in the refrigerating cycle. Since there is no need of collecting leaked refrigerant, it is not necessary to stop the heating operation to collect the refrigerant. In addition, there is no need to collect the refrigerant when starting the heating operation, so that the start-up of the heating operation will never be delayed due to collecting the refrigerant.

When kerosene is used as a fuel for the refrigerant heater 43, the kerosene is usually stored in a tank. When the kerosene in the tank is completely consumed, the refrigerant heater 43 is stopped even when a high heating capacity is required, and only the outdoor heat exchanger 47 is operated to continue the heating operation.

For carrying out a cooling operation, the four-way valve 19 circulates the refrigerant as indicated with dotted arrow marks. During the cooling operation, the two-way valve 53 is closed, and the refrigerant is sequentially circulated through the four-way valve 19, outdoor heat exchanger 47, expansion valve 57, indoor heat exchange 21, four-way valve 19, and the first cylinder 29 of the two-cylinder compressor 17.

During this operation, the heat exchanger 49 of the refrigerant heater 43 is substantially vacuumed by the second cylinder 31 of the compressor 17, so that no refrigerant is condensed and held in the heat exchanger 49.

Figure 5:
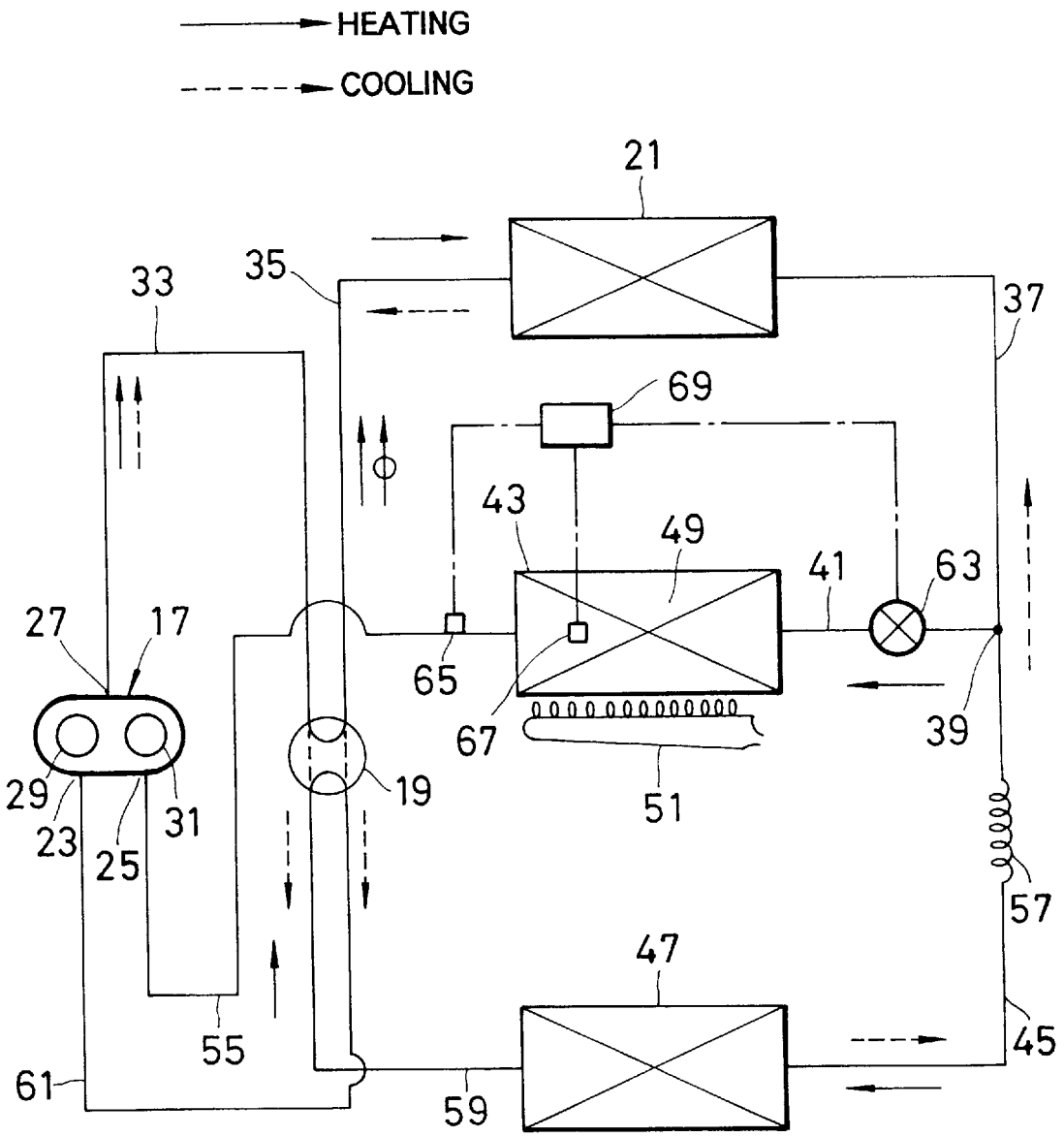
FIG. 5 is a schematic view showing a refrigerating cycle according to a second embodiment of the invention.

FIG. 5 shows the second embodiment of the invention. In the figure, the same parts as those of the first embodiment are represented with like reference marks, and parts essential for the second embodiment will be explained.

Instead of the two-way valve 53 of the first embodiment, the second embodiment employs a flow control valve 63, which is an electrically driven expansion valve whose opening is adjusted by a pulse motor valve.

The flow rate of circulating refrigerant must be changed in response to a required heating capacity. To achieve this, there is an inverter method for changing the rotational speed of the compressor 17, and a flow control valve method for controlling the flow rate of the refrigerant. The inverter method can widely change the flow rate of the refrigerant but cannot precisely adjust the same because the frequency of an inverter is usually changed in a stepwise manner. On the other hand, the flow control valve method is appropriate for precisely controlling the flow rate of the refrigerant.

The second embodiment employs the flow control valve 63 to precisely adjust the flow rate of refrigerant supplied to the refrigerant heater 43. Namely, the refrigerant heater 43 can receive a proper quantity of refrigerant depending on operating conditions.

The proper quantity of refrigerant is a quantity at which the refrigerant supplied to the compressor 17 from an outlet of the refrigerant heater 43 is provided with a proper degree of superheat and completely gasified.

To properly control the quantity of refrigerant in this way through the flow control valve 63, a first temperature sensor 65 for detecting the temperature of the refrigerant is disposed in the piping 55 at the outlet of the refrigerant heater 43, and a second temperature sensor 67 for detecting an evaporation temperature of the refrigerant is disposed in the heat exchanger 49. Also, there is arranged a controller 69 comprising a microcomputer for receiving values detected by the temperature sensors 65 and 67. According to the received values, the controller 69 calculates the proper degree of superheat of the refrigerant and provides an instruction to adjust the opening of the flow control valve 63.

Figure 6:
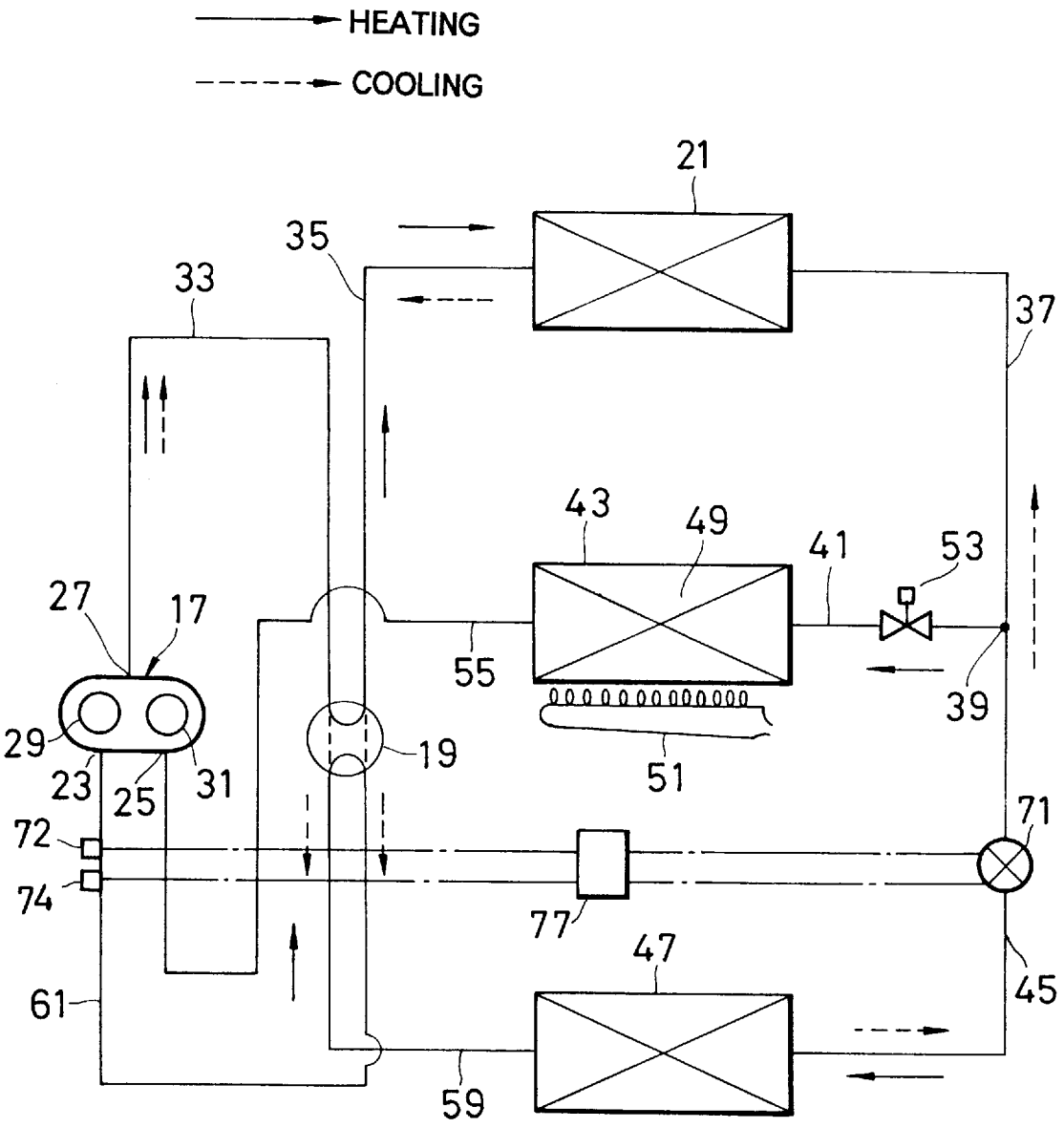
FIG. 6 is a schematic view showing a refrigerating cycle according to a third embodiment of the invention.

FIG. 6 shows the third embodiment of the invention.

Instead of the expansion valve 57 made of a capillary tube of the first embodiment of FIG. 3, the third embodiment employs a reversible temperature expansion valve 71. The "reversible" valve means a valve that is applicable for both heating and cooling operations in which the flow of refrigerant is reversed from one to another.

A temperature sensor 72 and a pressure sensor 74 are arranged in the piping 61 to the first cylinder 29 of the two-cylinder compressor 17. A controller 77 comprising a microcomputer receives signals from the sensors 72 and 74. The controller 77 controls the temperature expansion valve 71 so that a degree of superheat of the refrigerant exiting from the outdoor heat exchanger 47 and entering the first cylinder 29 of the compressor 17 is constant.

This arrangement optimizes the flow rate of the refrigerant according to operating conditions even if a required heating capacity is greatly changed to change the flow rate of the refrigerant. Also, this arrangement prevents liquefied refrigerant from flowing back into the compressor 17 and breaking the same. The third embodiment, therefore, effectively uses the heat exchanger 49 and widely changes a heating capacity.

Figure 7:
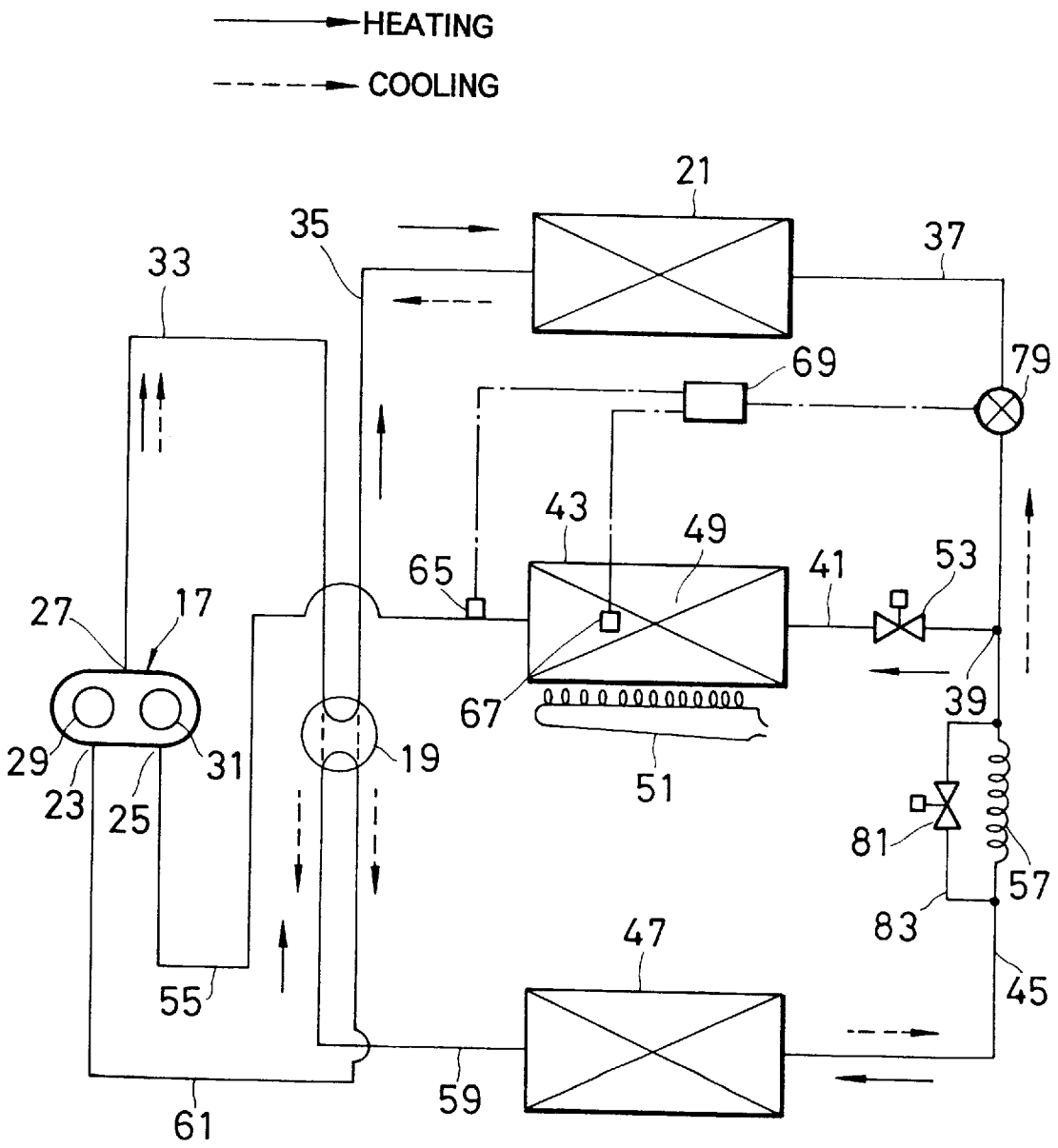
FIG. 7 is a schematic view showing a refrigerating cycle according to a fourth embodiment of the invention.

FIG. 7 shows the fourth embodiment of the invention.

This embodiment arranges a flow control valve 79 in the piping 37 between the indoor heat exchanger 21 and the branch 39 (refer to the first embodiment of FIG. 3), and bypass piping 83 having a two-way valve 81 disposed in parallel with the expansion valve 57 and serving as a bypassing open/close valve.

Similar to the second embodiment of FIG. 5, the fourth embodiment arranges a first temperature sensor 65 at the outlet of the refrigerant heater 43, and a second temperature sensor 67 in the heat exchanger 49.

Values detected by the sensors 65 and 67 are received by a controller 69, which calculates a degree of superheat of refrigerant according to the received values and provides instruction to adjust the opening of the flow control valve 79 when the refrigerant heater 43 is used.

When the refrigerant heating operation and heat pump operation are simultaneously carried out, the two-way valve 53 is opened, and the two-way valve 81 disposed in parallel with the expansion valve 57 is closed. In this case, the flow control valve 79 mainly adjusts the flow rate of the refrigerant flowing to the refrigerant heater 43 and causes not so much pressure loss in the coolant flow.

When the heat pump heating operation alone, or a cooling operation is carried out, the two-way valve 53 is closed, the two-way valve 81 opened, and the opening of the flow control valve 79 is contracted. In this case, the flow control valve 79 serves as an expansion valve.

When the refrigerant heating operation and heat pump operation are simultaneously carried out, most of the refrigerant flows to the refrigerant heater 43 and a very small quantity of the refrigerant to the outdoor heat exchanger 47 due to a pressure difference of the refrigerant between the refrigerant heater 43 and the outdoor heat exchanger 47.

On the other hand, during the cooling operation or the heat pump operation, a large amount of the refrigerant flows to the outdoor heat exchanger 47. Usually, a range of refrigerant quantities to be handled by the temperature expansion valve 57 is limited. When the quantity of the refrigerant flowing through the temperature expansion valve 57 exceeds the limit of the valve 57, the refrigerating cycle causes a hunting phenomenon, which causes abnormal overheat or a backward flow of liquefied refrigerant into the two-cylinder compressor 17.

To handle the changing refrigerant quantities, the fourth embodiment uses the different expansion valves for the two operating conditions. Namely, during the simultaneous refrigerant heating and heat pump operations, the expansion valve 57 is used as the expansion valve with the flow control valve 79 opened, and during the cooling operation or the heat pump heating operation, the opening of the flow control valve 79 is adjusted to use the valve 79 as the expansion valve. In this way, the fourth embodiment can stabilize the refrigerating cycle and realize a wide variable width of capacity.

Figure 8:
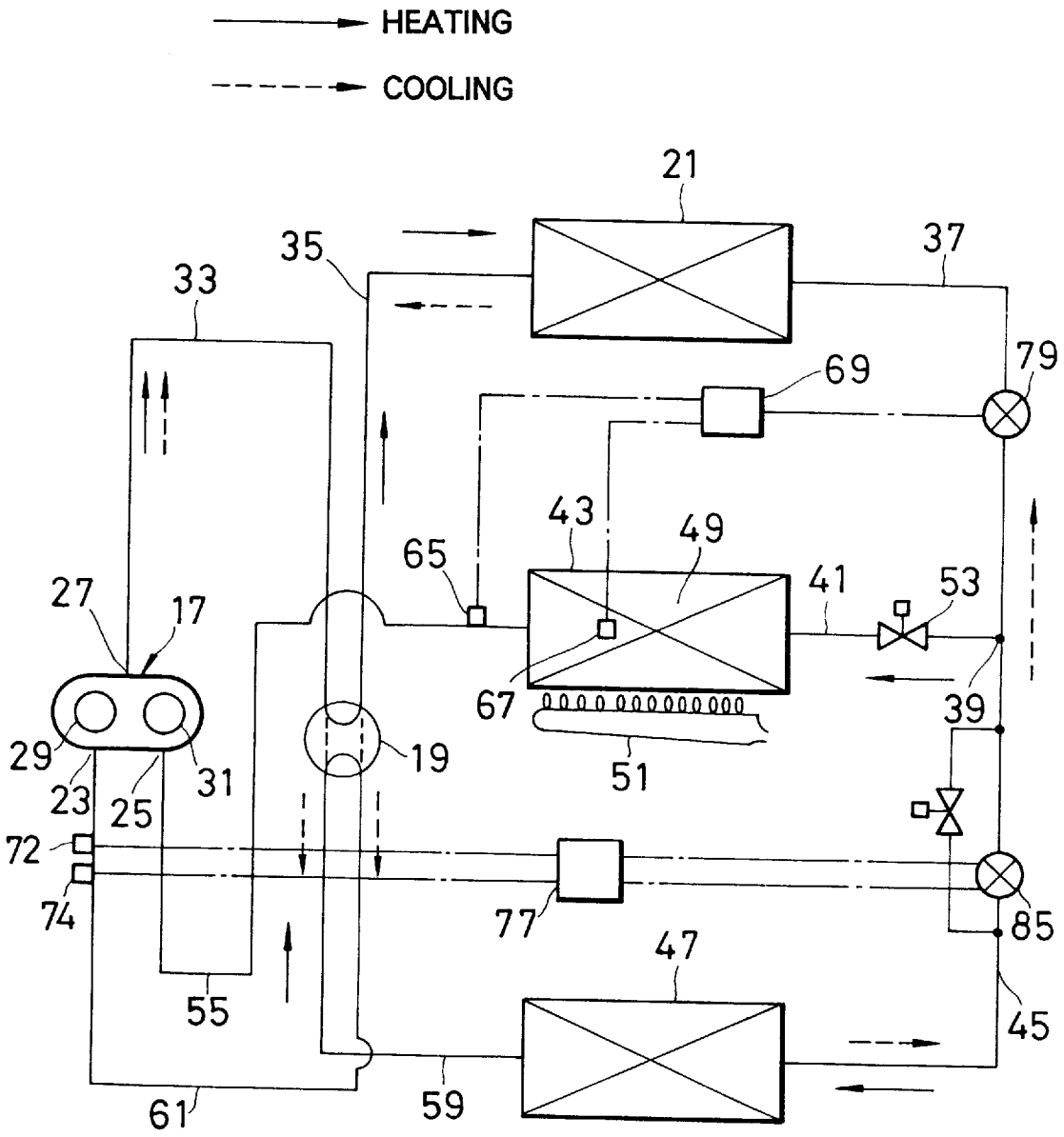
FIG. 8 is a schematic view showing a refrigerating cycle according to a fifth embodiment of the invention.

FIG. 8 shows the fifth embodiment of the invention.

Instead of the expansion valve 57 made of a capillary tube of the fourth embodiment of FIG. 7, the fifth embodiment employs a temperature expansion valve 85, which is not necessarily reversible, unlike the reversible temperature expansion valve 71 of the third embodiment of FIG. 6. Similar to the fourth embodiment of FIG. 7, the fifth embodiment realizes a wide variable range of capacity.

Figure 9:
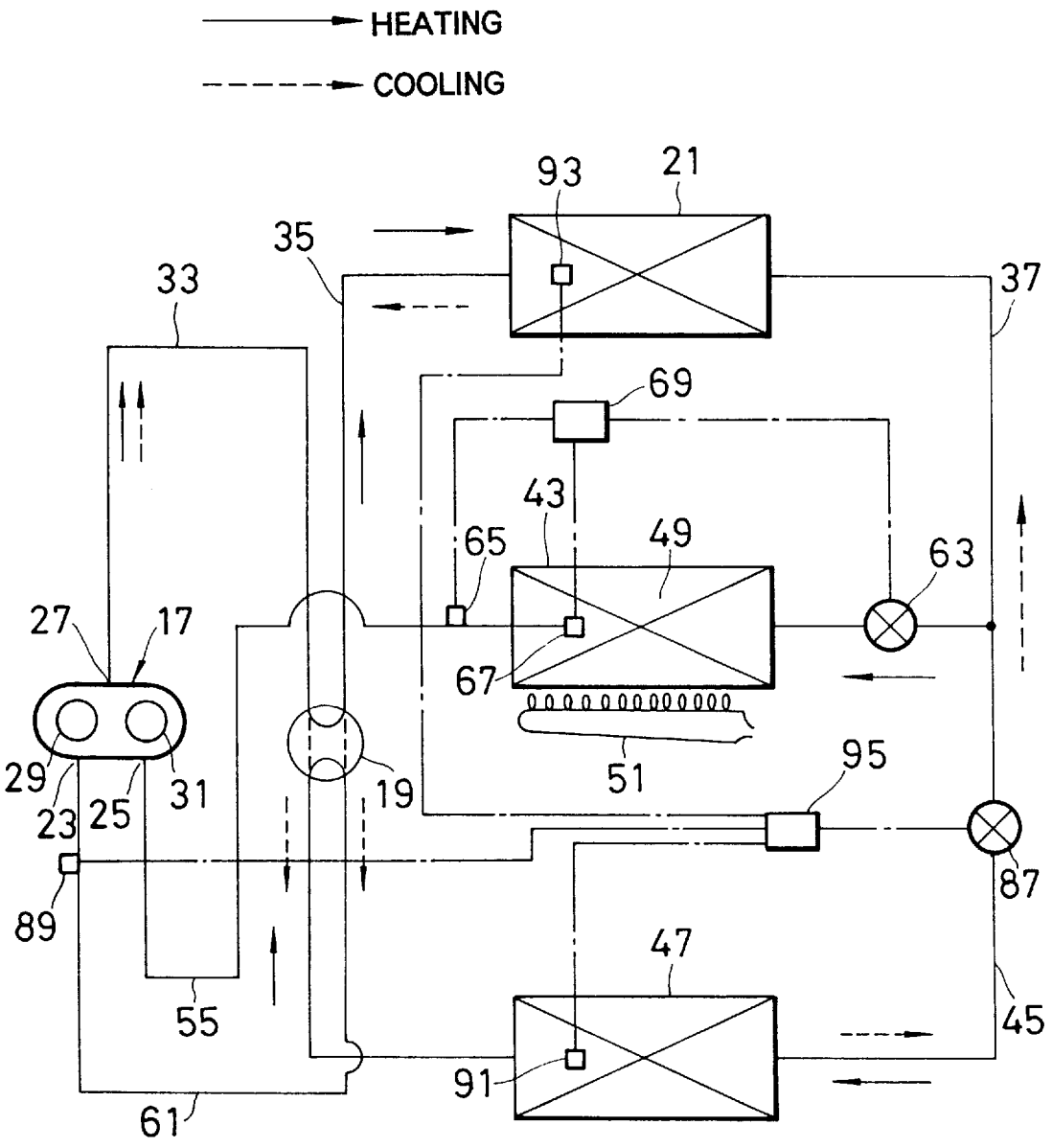
FIG. 9 is a schematic view showing a refrigerating cycle according to a sixth embodiment of the invention.

FIG. 9 shows the sixth embodiment of the invention.

Instead of the expansion valve 57 made of a capillary tube of the second embodiment of FIG. 5, the sixth embodiment employs a flow control valve 87 functioning as an expansion valve. Similar to the flow control valve 63 of the second embodiment, the flow control valve 87 is of a standard electric type.

In FIG. 9, numeral 89 denotes a temperature sensor for detecting a temperature at an inlet of the first cylinder 29 of the two-cylinder compressor 17, 91 a temperature sensor for detecting an evaporation temperature in the outdoor heat exchanger 47, and 93 a temperature sensor for detecting a temperature in the indoor heat exchanger 21.

The sensors 89, 91 and 93 provide detected values to a controller 95. The controller 95 calculates a degree of superheat of the outdoor heat exchanger 47 during a heating operation and of the indoor heat exchanger 21 during a cooling operation, according to the temperatures detected by two of the sensors, to adjust the opening of the flow control valve 87.

This embodiment provides a proper degree of superheat for each of the heat exchanges during the heating operation carried out with the simultaneous refrigerant heating and heat pump operations, during the heating operation carried out only with the heat pump operation, and during the cooling operation. This embodiment achieves a wide variable range of capacity.

As explained above, the invention simultaneously carries out the refrigerant heating operation and heat pump operation when a required heating capacity is high, and when the required heating capacity is low, only the heat pump operation for ensuring a low heating capacity range. This widens a variable range of capacity and provides a user with comfortable air-conditioning.

For achieving a high heating capacity, the invention simultaneously carries out the refrigerant heating operation and heat pump operation, thereby effectively using the outdoor heat exchanger, reducing the size of the refrigerant heater, and saving the overall size of the apparatus.

The invention always uses the outdoor heat exchanger not only during the cooling operation but also during the heating operation. As a result, refrigerant never stays in the outdoor heat exchanger, a shortage of the refrigerant in the refrigerating cycle never occurs, the troublesome refrigerant collecting work is eliminated, and a start-up time of the heating operation is shortened.

When simultaneously carrying out the refrigerant heating operation and heat pump operation, the invention opens the open/close valve and closes the bypassing open/close valve disposed in parallel with the expansion valve. In this case, the flow control valve disposed on the refrigerant outlet side of the indoor heat exchanger mainly adjusts the flow rate of the refrigerant flowing to the refrigerant heater during the heating operation.

On the other hand, when carrying out only the heat pump operation or the cooling operation, the invention closes the open/close valve, opens the bypassing open/close valve, and contracts the opening of the flow control valve. In this case, the flow control valve functions as an expansion valve.

In this way, the invention uses the different expansion valves for the two operating conditions, to deal with changes in the flow rate of refrigerant. This technique stabilizes the refrigerating cycle and widens a variable range of capacity.

Figure 10:
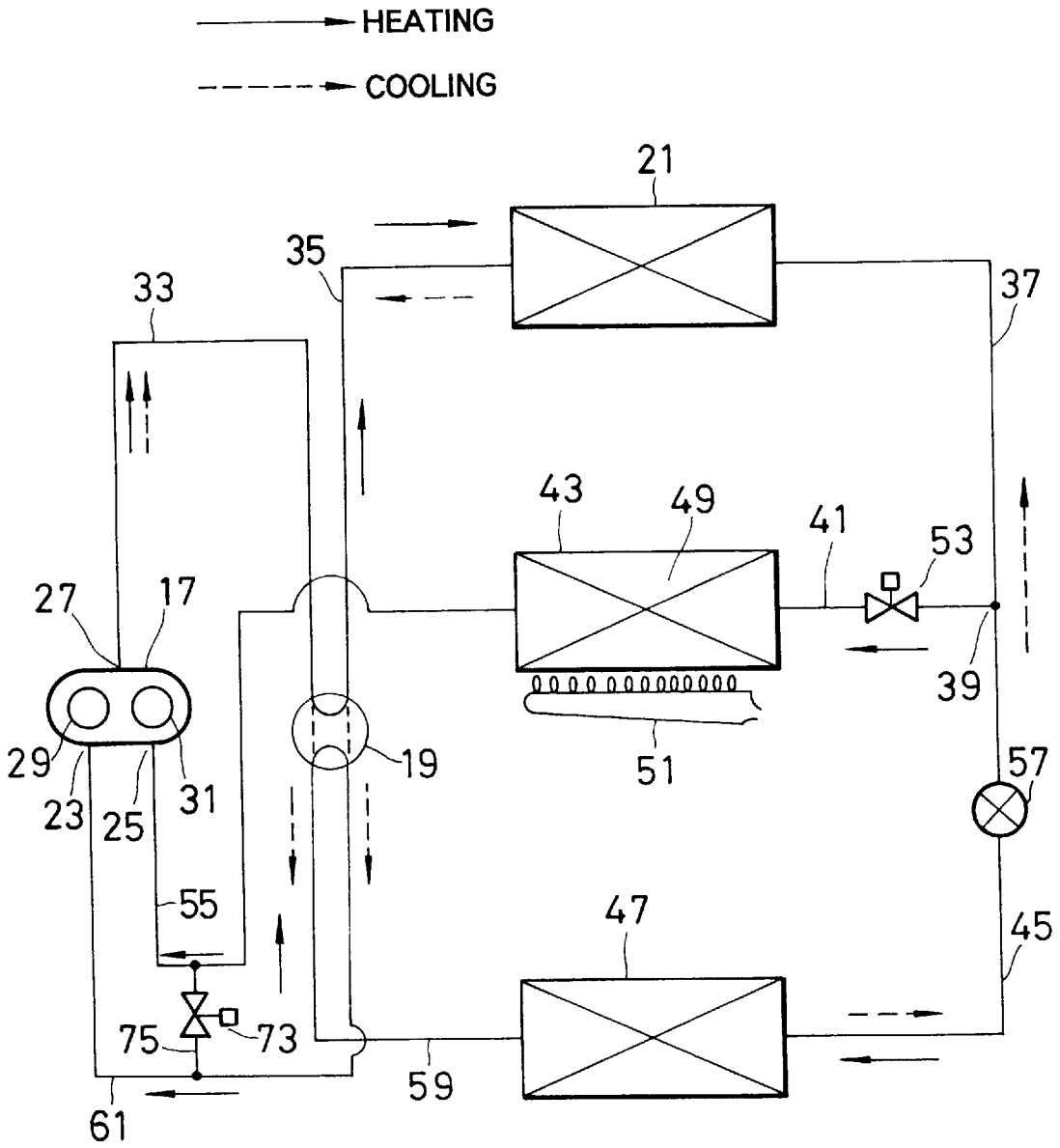
FIG. 10 is a schematic view showing a refrigerating cycle according to a seventh embodiment of the invention.

FIG. 10 is a schematic view showing a refrigerating cycle of an air-conditioning apparatus according to the seventh embodiment of the invention.

The air-conditioning apparatus comprises, in refrigerant flowing order during a heating operation, a two-cylinder compressor 17, a four-way valve 19 serving as a directional control valve, and an indoor heat exchanger 21. The two-cylinder compressor 17 has two suction ports 23 and 25, a discharge port 27, and first and second cylinders 29 and 31 corresponding to the two suction ports 23 and 25, respectively. The first and second cylinders 29 and 31 are simultaneously driven. The discharge port 27 of the compressor 17 is connected to the four-way valve 19 through piping 33. The four-way valve 19 is connected to the indoor heat exchanger 21 through piping 35.

Refrigerant exiting from the indoor heat exchanger 21 is passed through piping 37 and divided into two flows through a branch 39. One of the two flows is guided toward a refrigerant heater 43 through piping 41, and the other flow toward an outdoor heat exchanger 47 through piping 45.

The refrigerant heater 43 comprises a refrigerant heater, heat exchanger 49 and a burner 51.

A two-way valve 53 serving as an open/close valve is disposed in the piping 41 to the refrigerant heater 43. The two-way valve 53 closes the refrigerant path to the refrigerant heater 43 during a single heat pump heating operation carried out by the outdoor heat exchanger 47 without using the refrigerant heater 43, or during a cooling operation that does not require the refrigerant heater 43.

The refrigerant exiting from the refrigerant heater 43 flows through piping 55, which is connected to the suction port 25 corresponding to the second cylinder 31 of the two-cylinder compressor 17.

An expansion valve 57 is disposed in the piping 45 between the branch 39 and the outdoor heat exchanger 47. The expansion valve 57 decreases the pressure of refrigerant so that the refrigerant can absorb atmospheric heat during the heat pump operation. The expansion valve 57 may be formed from a capillary tube.

The refrigerant exiting from the outdoor heat exchanger 47 flows to the two-cylinder compressor 17 through the four-way valve 19. The outdoor heat exchanger 47 is connected to the four-way valve 19 through piping 59. The four-way valve 19 is connected to the suction port 23 corresponding to the first cylinder 29 of the compressor 17 through piping 61. The piping 61 is connected to the piping 55 through piping 75 in which a two-way valve 73 serving as a second open/close valve is disposed.

When a large heating capacity is required, the refrigerant heating operation and heat pump operation are simultaneously carried out. In this case, the two-way valve 53 on the upstream side of the refrigerant heater 43 is opened, and the two-way valve 73 on the upstream side of the two-cylinder compressor 17 is closed. Accordingly, separate parallel flows of refrigerant pass through the high-pressure refrigerant heater 43 and the low pressure outdoor heat exchanger 47, and absorb combustion heat and atmospheric heat, respectively.

In this way, for providing a large heating capacity, the refrigerant absorbs not only combustion heat in the refrigerant heater 43 but also atmospheric heat in the outdoor heat exchanger 47. With this simultaneous heat absorption from the two heat sources, the outdoor heat exchanger 47 is effectively utilized. Compared with a singular operation of the refrigerant heater 43, the cooperative operation of the refrigerant heater 43 and the heat pump (the outdoor heat exchanger 47) can reduce the sizes of the refrigerant heater 43 and the apparatus as a whole for a portion of heat provided by the heat pump.

When providing a small heating capacity, the two-way valve 53 is closed to stop the operation of the refrigerant heater 43, and only the heat pump operation using the outdoor heat exchanger 47 is carried out. At this time, the two-way valve 73 on the upstream side of the two-cylinder compressor 17 is closed. The refrigerant exiting from the outdoor heat exchanger 47, therefore, does not flow to the piping 55 but flows only to the first cylinder 29 of the compressor 17 through the piping 61.

This realizes a very small heating capacity compared with that achieved by the two flows of refrigerant circulated through the first and second cylinders 29 and 31 of the compressor 17, and expands an overall variable width of heating capacity of the air-conditioning apparatus.

With this extended variable width covering a low capacity heating operation, the refrigerant heater 43 is not required to be repeatedly turned ON and OFF even for a small heating load. As a result, a user may enjoy comfortable air-conditioning. Since the refrigerant heater 43 can be continuously operated without the ON/OFF operation, a running cost is reduced compared with the ON/OFF operation. Unlike the ON/OFF operation, the continuous operation does not deteriorate the durability of the burner 51, nor condense combustion gases in the heat exchanger 49 of the refrigerant heater 43, so that the heat exchanger 49 may not be corroded due to high acidity of condensed combustion gases.

When providing a low heating capacity, the two-way valves 53 and 73 are both closed. During this period, the heat exchanger 49 of the refrigerant heater 43 is substantially vacuumed by the second cylinder 31 of the compressor 17, so that no refrigerant may be condensed and held in the heat exchanger 49. Also, since the outdoor heat exchanger 47 is always used, there is no risk of holding refrigerant in the outdoor heat exchanger 47.

Since no refrigerant is held in the heat exchanger 49 and outdoor heat exchanger 47, no shortage of the refrigerant occurs in the refrigerating cycle. Since there is no need of collecting leaked refrigerant, it is not necessary to stop the heating operation to collect the refrigerant. In addition, there is no need to collect the refrigerant when starting the heating operation, so that the start-up of the heating operation will never be delayed due to collecting the refrigerant.

When kerosene is used as a fuel for the refrigerant heater 43, the kerosene is usually stored in a tank. When the kerosene in the tank is completely consumed, the refrigerant heater 43 is stopped even if a required heating capacity is high, and only the outdoor heat exchanger 47 is operated to continue the heating operation.

For carrying out a cooling operation, refrigerant from the four-way valve 19 flows as indicated with dotted arrow marks. During the cooling operation, the two-way valve 53 on the upstream side of the refrigerant heater 43 is closed, and the two-way valve 73 on the upstream side of the two-cylinder compressor 17 is opened. The refrigerant exiting from the four-way valve 19 is sequentially circulated through the outdoor heat exchanger 47, expansion valve 57, indoor heat exchanger 21, four-way valve 19, and the two-cylinder compressor 17.

Since the two-way valve, 73 on the upstream side of the compressor 17 is open, the refrigerant exiting from the four-way valve 19 flows through both the piping 61 and 55, and the first and second cylinders 29 and 31 of the compressor 17 simultaneously draw the refrigerant to improve a cooling capacity.

Figure 11:
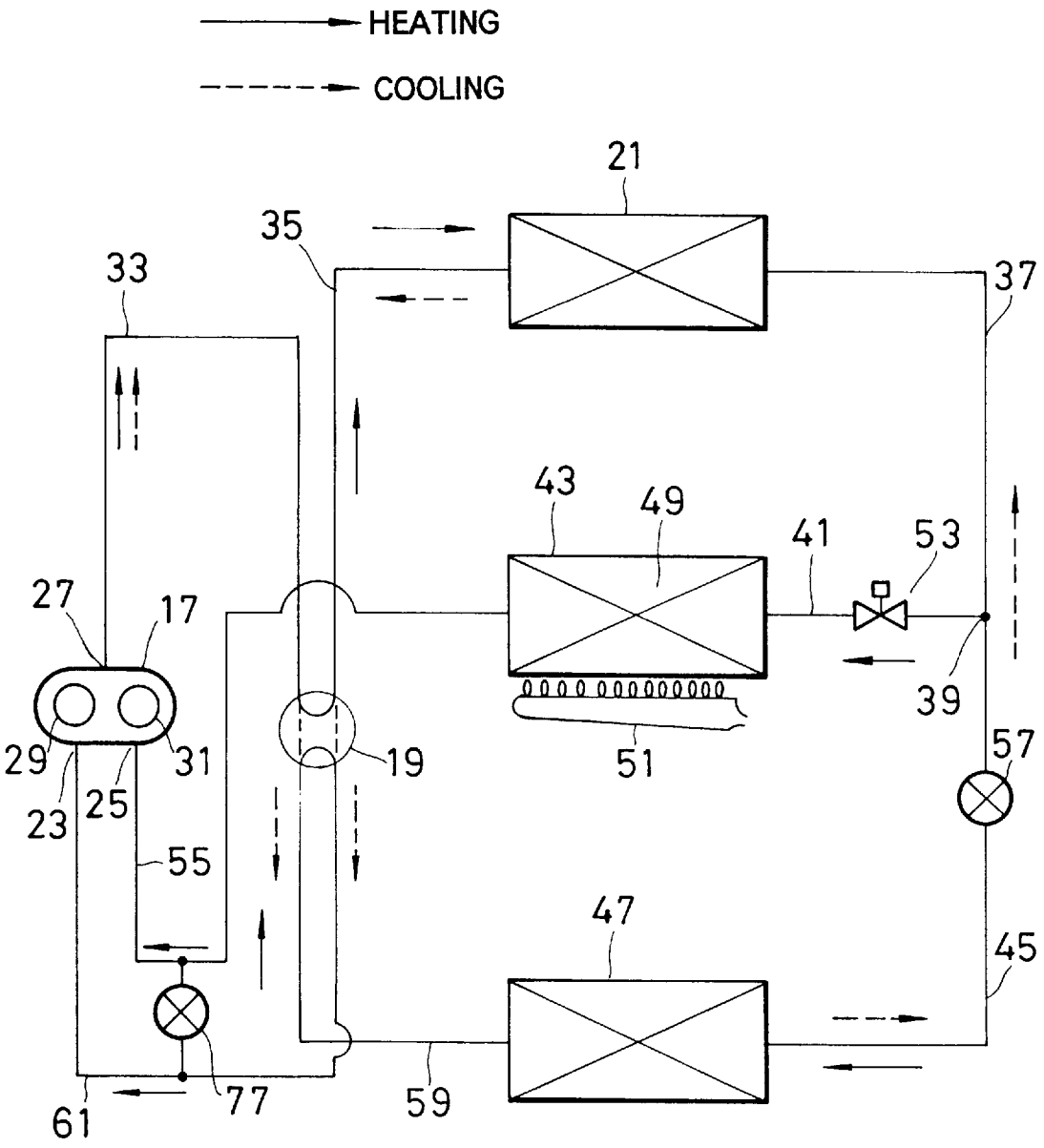
FIG. 11 is a schematic view showing a refrigerating cycle according to an eighth embodiment of the invention.

FIG. 11 shows the eighth embodiment of the invention. In the figure, the same parts as those of the seventh embodiment are represented with like reference marks. Only essential parts of the eighth embodiment will be explained.

Instead of the two-way valve 73 on the upstream side of the compressor 17 of the seventh embodiment, the eighth embodiment employs a flow control valve 77, which is an electrically driven expansion valve whose opening is varied by a pulse motor valve. By changing the opening of the flow control valve 77, a cooling capacity for a cooling operation can be widely varied.

Figure 12:
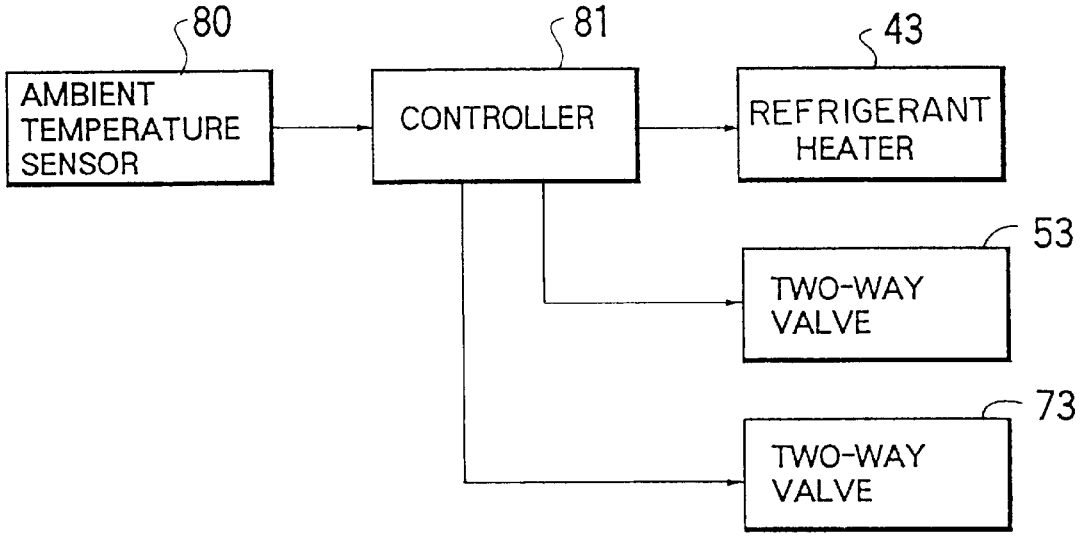
FIG. 12 is a block diagram showing an example of a heating operation control process for the refrigerating cycle of FIG. 10.
Figure 13:
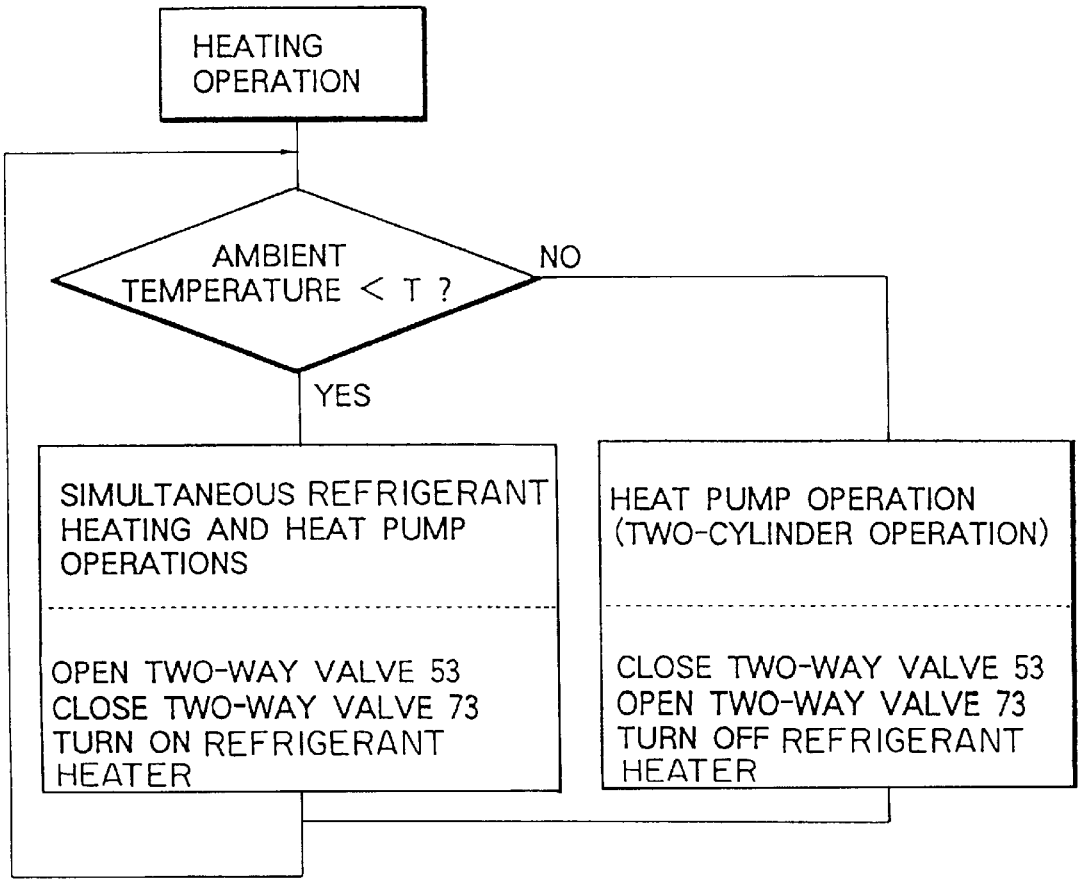
FIG. 13 is a flowchart showing the control process of FIG. 12.

FIGS. 12 and 13 are a block diagram and a flowchart showing an example of heating operation control of the refrigerating cycle of FIG. 10.

To achieve this control, the refrigerating cycle of FIG. 10 is provided with an ambient temperature sensor 80 and a controller 81 comprising, for example, a microcomputer. When an ambient temperature detected by the ambient temperature sensor 80 is smaller than a predetermined value T, the controller 81 simultaneously carried out the refrigerant heating operation and heat pump operation, and when the ambient temperature is greater than the predetermined value T, only the heat pump operation.

As is known, the efficiency of the heat pump operation that absorbs atmospheric heat decreases as an ambient temperature decreases. When the ambient temperature is high, the heat pump operation demonstrates very good efficiency. The running cost of the heat pump will be lower than that of the refrigerant heater 43 depending on a fuel used for the refrigerant heater 43.

In consideration of these facts, the two-way valve 53 is opened and the two-way valve 73 is closed when the ambient temperature is smaller than the predetermined value T, as shown in FIG. 13, to operate the refrigerant heater 43 to simultaneously achieve the refrigerant heating operation and heat pump operation, thereby preventing lowering the heating capacity.

When the ambient temperature is greater than the predetermined value T, the two-way valve 53 is closed while the two-way valve 73 is opened, to stop the refrigerant heater 43 to carry out only the heat pump operation for achieving the heating operation. When a required heating capacity is small during the heat pump operation, the two-way valve 73 is closed to use only the first cylinder 29 of the compressor 17.

Figure 14:
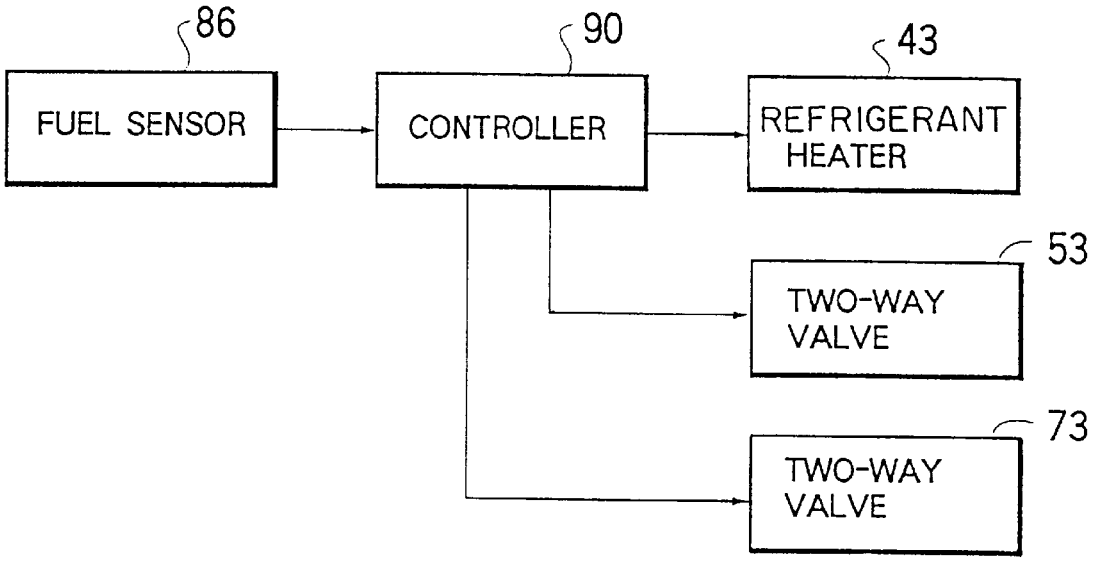
FIG. 14 is a block diagram showing another example of the heating operation control process.
Figure 15:
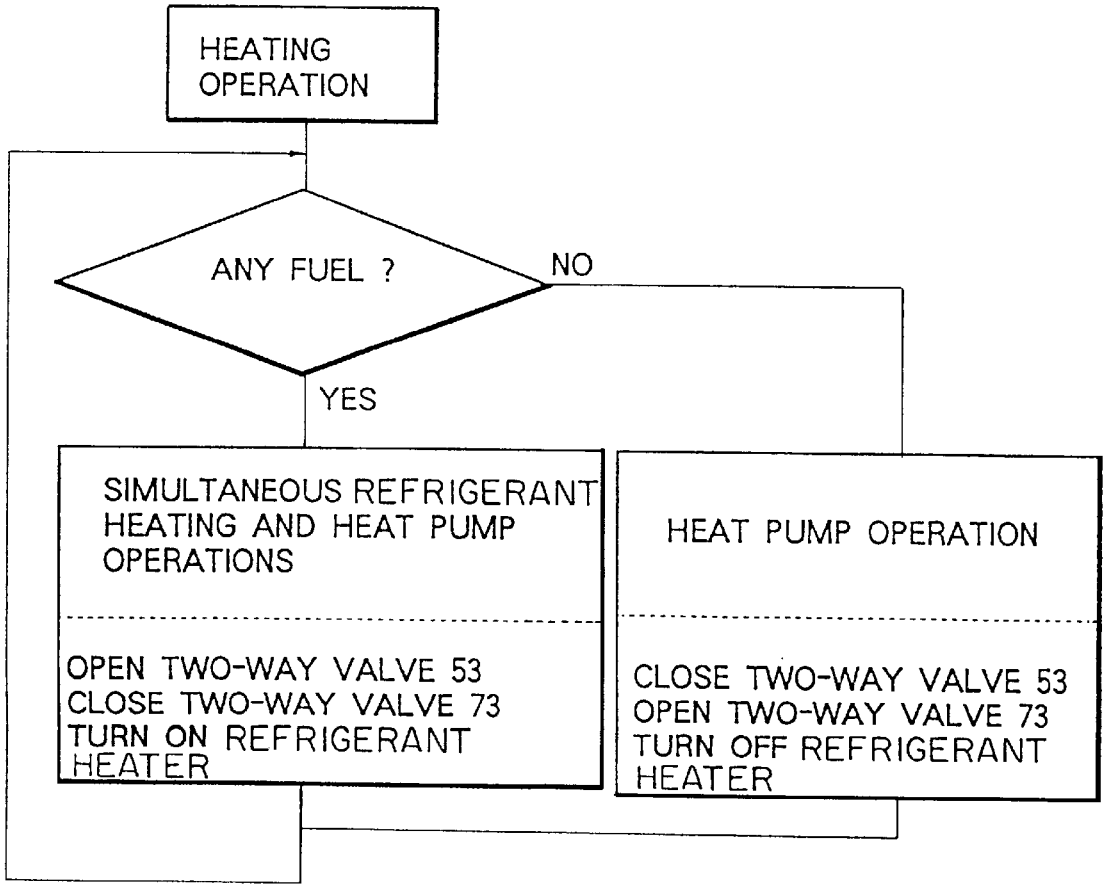
FIG. 15 is a flowchart showing the control process of FIG. 14.

FIGS. 14 and 15 are a block diagram and a flowchart showing another example of heating control.

To achieve this control, the refrigerating cycle of FIG. 10 is provided with a fuel sensor 86 for detecting a shortage of fuel such as kerosene and a propane gas, and a controller 90 comprising, for example, a microcomputer serving as control means for receiving an output signal of the fuel sensor 86 and controlling the refrigerant heater 43 and two-way valves 53 and 73.

When a fuel for the refrigerant heater 43 is entirely consumed, the two-way valve 53 is closed and the two-way valve 73 opened to stop the refrigerant heater 43 and carry the heat pump operation through the first and second cylinders 29 and 31 of the compressor 17, irrespective of an ambient temperature. In this way, even if the fuel for the refrigerant heater 43 runs out, the heating operation is continued, though the heating capacity of the heat pump operation may not be sufficient if the ambient temperature is low to require a large heating capacity.

Figure 16:
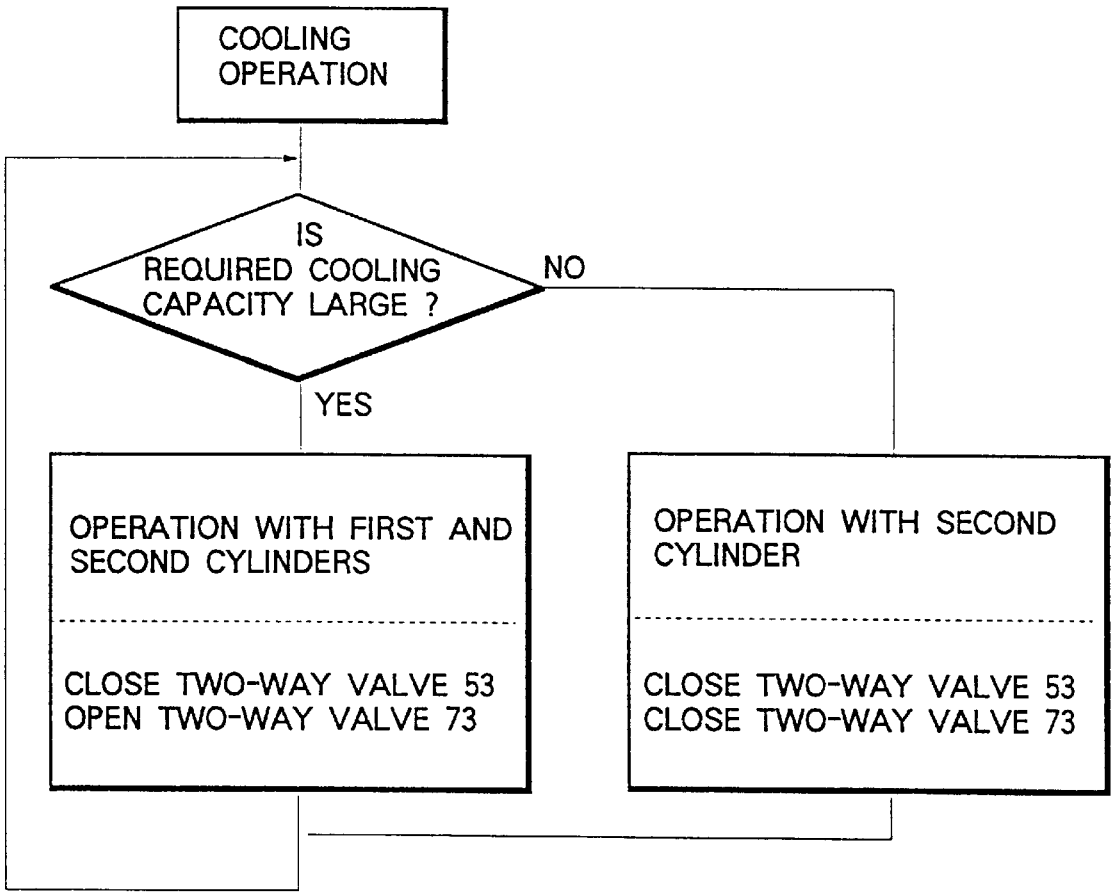
FIG. 16 is a flowchart showing an example of a cooling operation.

FIG. 16 shows an example of cooling operation control.

When a required cooling capacity is large in the refrigerating cycle of FIG. 10, the two-way valve 73 is opened to use the first and second cylinders 29 and 31 of the compressor 17. When the required cooling capacity is small, the two-way valve 73 is closed to use only the first cylinder 29 of the compressor 17.

Figure 17:
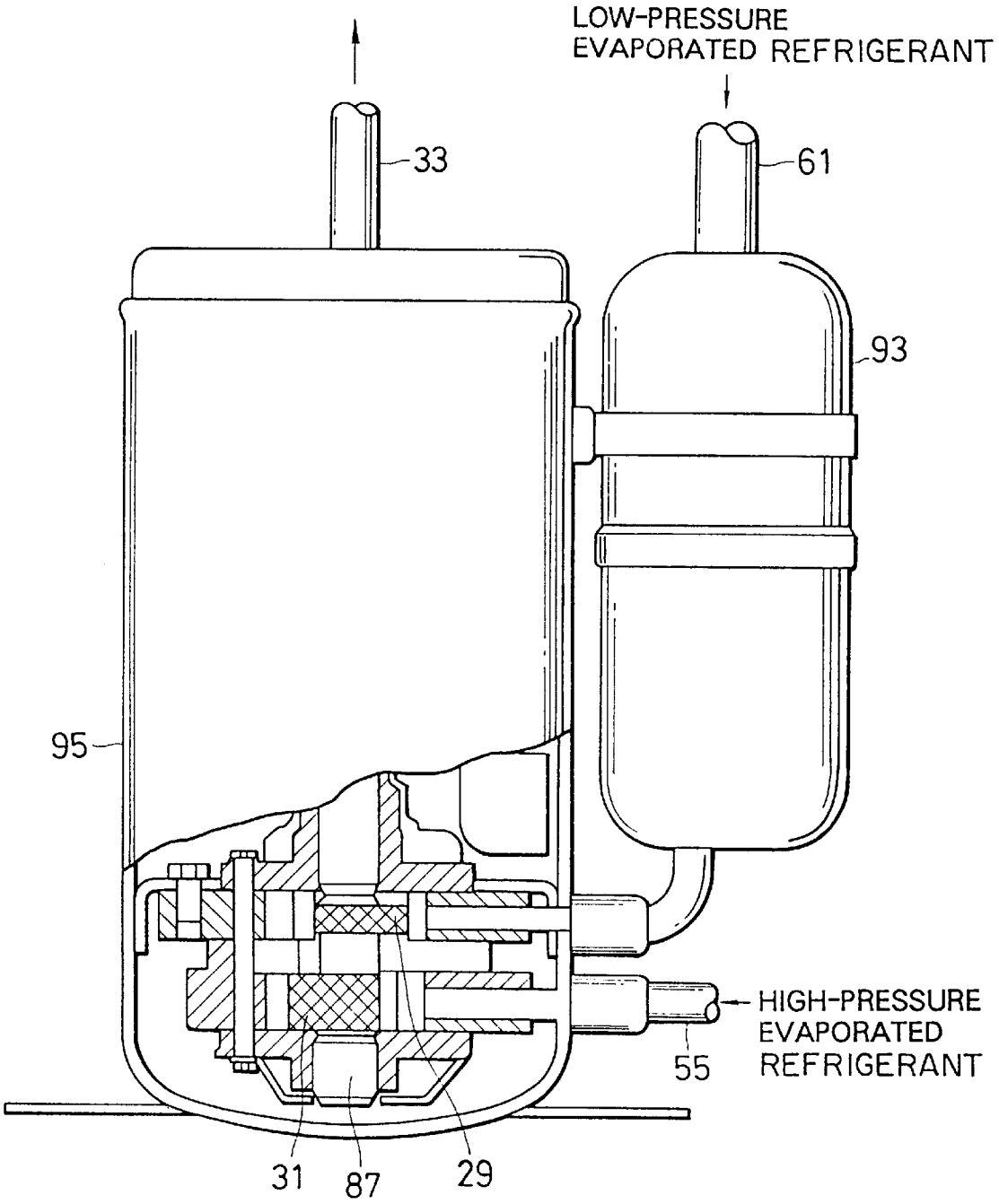
FIG. 17 is a partly broken sectional view showing an essential part of a two-cylinder compressor according to a ninth embodiment of the invention.

FIG. 17 shows an essential part of a two-cylinder compressor 87 according to the ninth embodiment of the invention.

The compressor 87 substitutes for the two-cylinder compressor 17 of the seventh embodiment of FIG. 10. What is different from the two-cylinder compressor 17 is that a first cylinder 29 connected to the low pressure piping 61 has a smaller volume, while a second cylinder 31 connected to the high pressure piping 55 for the refrigerant heater 43 has a larger volume. A suction cup 93 is arranged in the piping 61.

When the refrigerant heating operation and heat pump operation are simultaneously carried out to provide a large heating capacity, evaporated refrigerant from the refrigerant heater 43 has high pressure because it is not contracted, and is fed into the second cylinder 31 of larger volume. On the other hand, evaporated refrigerant from the outdoor heat exchanger 47 has low pressure and is fed into the first cylinder 29 of smaller volume.

The high-pressure evaporated refrigerant in the second cylinder 31 is slightly compressed and discharged into a compressor casing 95. The low-pressure evaporated refrigerant in the first cylinder 29 is compressed to high pressure and discharged into the compressor casing 95.

A pressure ratio of suction side to discharge side, i.e., a compression ratio of the first cylinder 29 of smaller volume is larger than that of the second cylinder 31 of larger volume. Namely, in consideration of the compression ratio, torque of the first cylinder may be larger than that of the second cylinder 31. The quantity of vapor to be compressed in the first cylinder 29, however, is smaller than that in the second cylinder 31. Accordingly, by properly adjusting the volumes of the cylinders 29 and 31, the torque of both the cylinders may be equalized to each other to provide balanced rotations and reduce vibration and noise. This arrangement may remarkably reduce the vibration and noise of an outdoor unit in which the compressor is disposed.

As explained above, the invention simultaneously carries out the refrigerant heating operation and heat pump operation when a required heating capacity is high, and only the heat pump operation when the required heating capacity is low. During the low heating capacity operation, the invention closes the second open/close valve, thereby drawing refrigerant into one of the cylinders of the compressor to secure the low heating capacity. This realizes a very wide variable width of capacity, and provides a user with comfortable air-conditioning.

Figure 18:
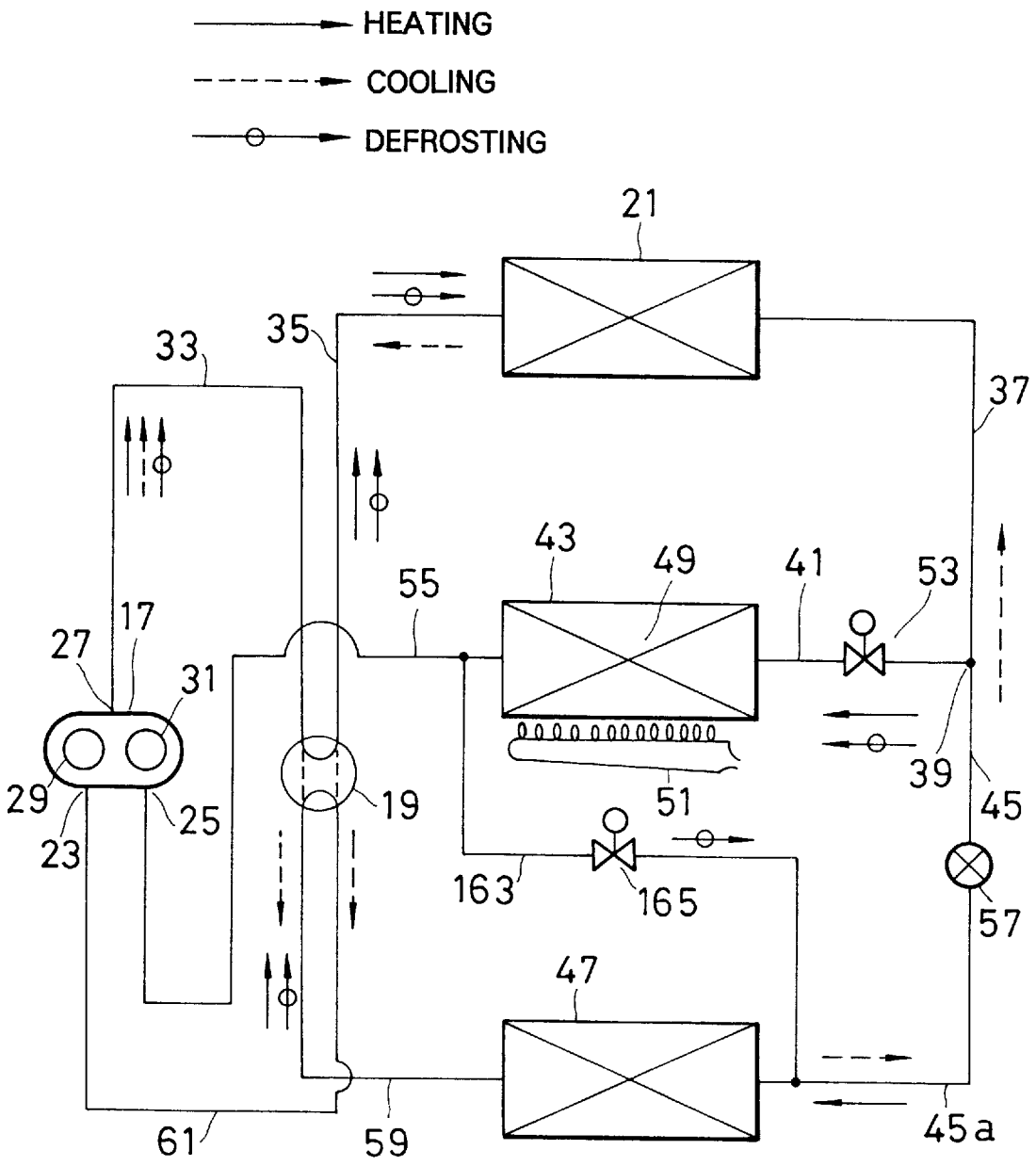
FIG. 18 is a schematic view showing a refrigerating cycle according to a tenth embodiment of the invention.

FIG. 18 is a schematic view showing a refrigerating cycle of an air-conditioning apparatus according to the tenth embodiment of the invention.

The air-conditioning apparatus comprises, in refrigerant flowing order during a heating operation, a two-cylinder compressor 17, a four-way valve 19 serving as a directional control valve, and an indoor heat exchanger 21. The compressor 17 has two suction ports 23 and 25, a discharge port 27, and simultaneously driven first and second cylinders 29 and 31. The discharge port 27 of the compressor 17 is connected to the four-way valve 19 through piping 33, and the four-way valve 19 is connected to the indoor heat exchanger 21 through piping 35.

Refrigerant exiting from the indoor heat exchanger 21 is passed through piping 37 and divided into two flows through a branch 39. One of the two flows is guided to a refrigerant heater 43 through piping 41, and the other flow to an outdoor heat exchanger 47 through piping 45.

The refrigerant heater 43 comprises a refrigerant heater heat exchanger 49 and a burner 51.

An expansion valve 57 is disposed in the piping 45, to decrease the pressure of refrigerant so that the refrigerant can absorb atmospheric heat during a heat pump operation.

A two-way valve 53 serving as a first open/close valve is disposed in the piping 41 to the refrigerant heater 43. The two-way valve 53 closes the refrigerant path to the refrigerant heater 43 during a heating operation that is carried out only with the heat pump operation without using the refrigerant heater 43, or during a cooling operation that does not require the refrigerant heater 43, Refrigerant exiting from the refrigerant heater 43 flows through piping 55 connected to the suction port 25 of the two-cylinder compressor 17.

The outdoor heat exchanger 47 is connected to the four-way valve 19 through piping 59, and the four-way valve 19 is connected to the suction port 23 of the compressor 17 through piping 61.

The piping 55 for connecting the refrigerant heater 43 with the compressor 17 is connected to piping **45*a* for connecting the outdoor heat exchanger 47 with the expansion valve 57, through bypass piping 163 in which a second open/close valve 165** is disposed.

When a large heating capacity is required, the refrigerant heating operation and heat pump operation are simultaneously carried out. If the outdoor heat exchanger 47 is frosted due to ambient conditions during the heating operation, a defrosting signal is provided to open the two-way valve 165. As a result, part of high-temperature evaporated refrigerant from the refrigerant heater 43 flows to the piping 45*a* through the bypass piping 163, to defrost the outdoor heat exchanger 47.

Since the defrosting operation is carried out without changing the four-way valve 19, the remaining part of the high temperature refrigerant from the refrigerant heater 43 is continuously fed to the indoor heat exchanger 21 through the compressor 17, thereby continuing the heating operation to provide a user with comfortable air-conditioning.

Before opening the two-way valve 165 for the defrosting operation, a thermal output of the refrigerant heater 43 may be slightly increased to prevent lowering the heating capacity during the defrosting operation.

When a low heating capacity is required, only the heat pump operation is carried out. In this case, the two-way valve 53 on the upstream side of the refrigerant heater 43 is closed to stop the refrigerant heater 43. When the defrosting signal is provided during this period, the two-way valve 53 is opened to activate the refrigerant heater 43. At the same time, the two-way valve 165 is opened to defrost the outdoor heat exchanger 47, similar to the above explanation. Before opening the two-way valve 53, the refrigerant heater 43 may be activated in advance to a preheated state. This may quickly defrost the outdoor heat exchanger 47 and reduce a risk of causing a liquefied refrigerant to flow back into the compressor 17.

Figure 19:
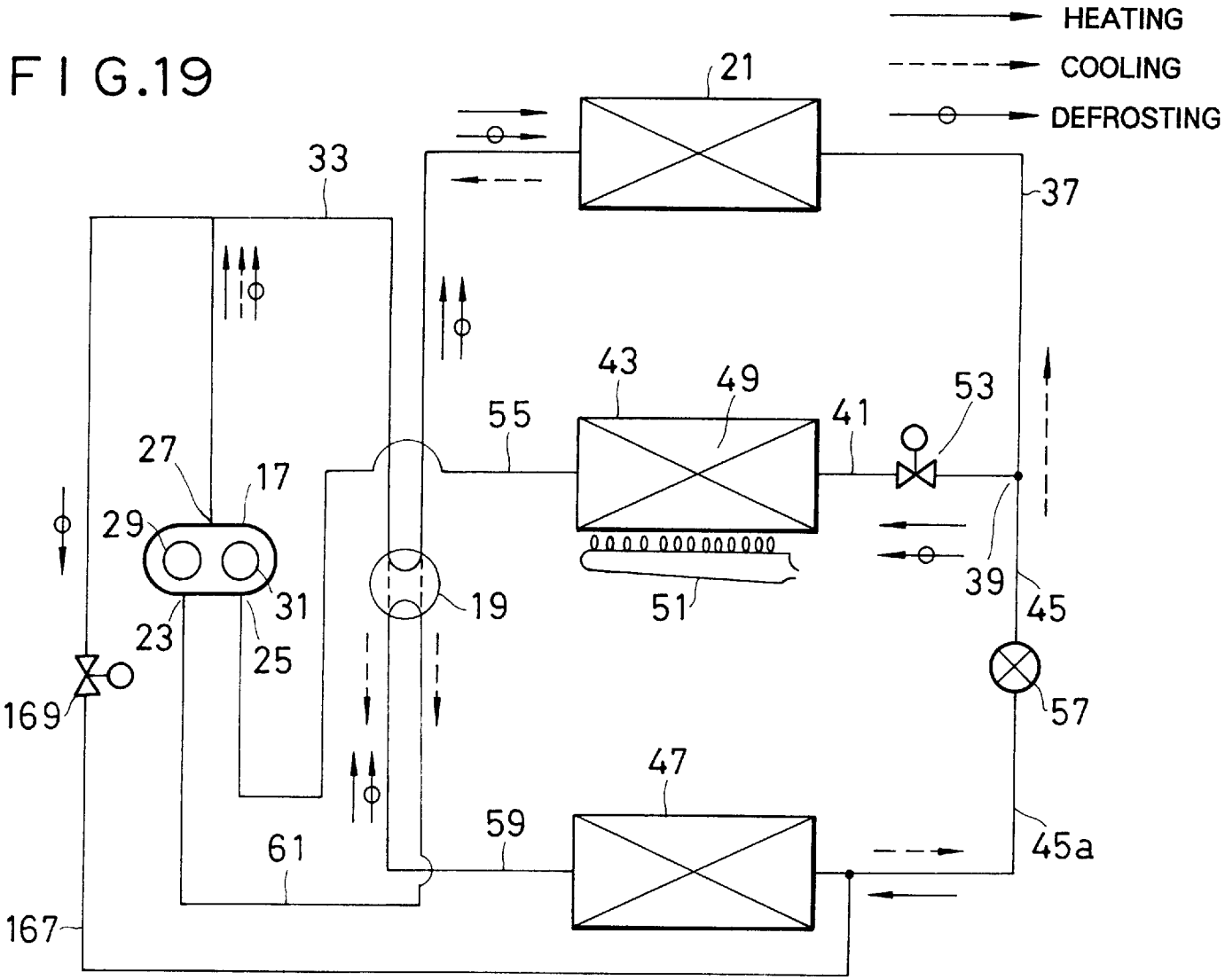
FIG. 19 is a schematic view showing a refrigerating cycle according to an eleventh embodiment of the invention.

FIG. 19 shows the eleventh embodiment of the invention. In the figure, the same parts as those of the tenth embodiment of FIG. 18 are represented with like reference marks, and only essential parts of the eleventh embodiment will be explained.

The eleventh embodiment is not provided with the bypass piping 163 and two-way valve 165 of the tenth embodiment. Instead, the piping 27 on the discharge side of the compressor 17 is connected through bypass piping 167 with the piping 45*a* for connecting the outdoor heat exchanger 47 with the expansion valve 57. A two-way valve 169 serving as a second open/close valve is disposed in the bypass piping 167. The operation of the two-way valve 169 is the same as that of the two-way valve 165 of the tenth embodiment. Part of high-temperature evaporated refrigerant passing through the piping 27 on the discharge side of the compressor 17 is sent to the outdoor heat exchanger 47 through the bypass piping 167 to defrost the outdoor heat exchanger 47.

Figure 20:
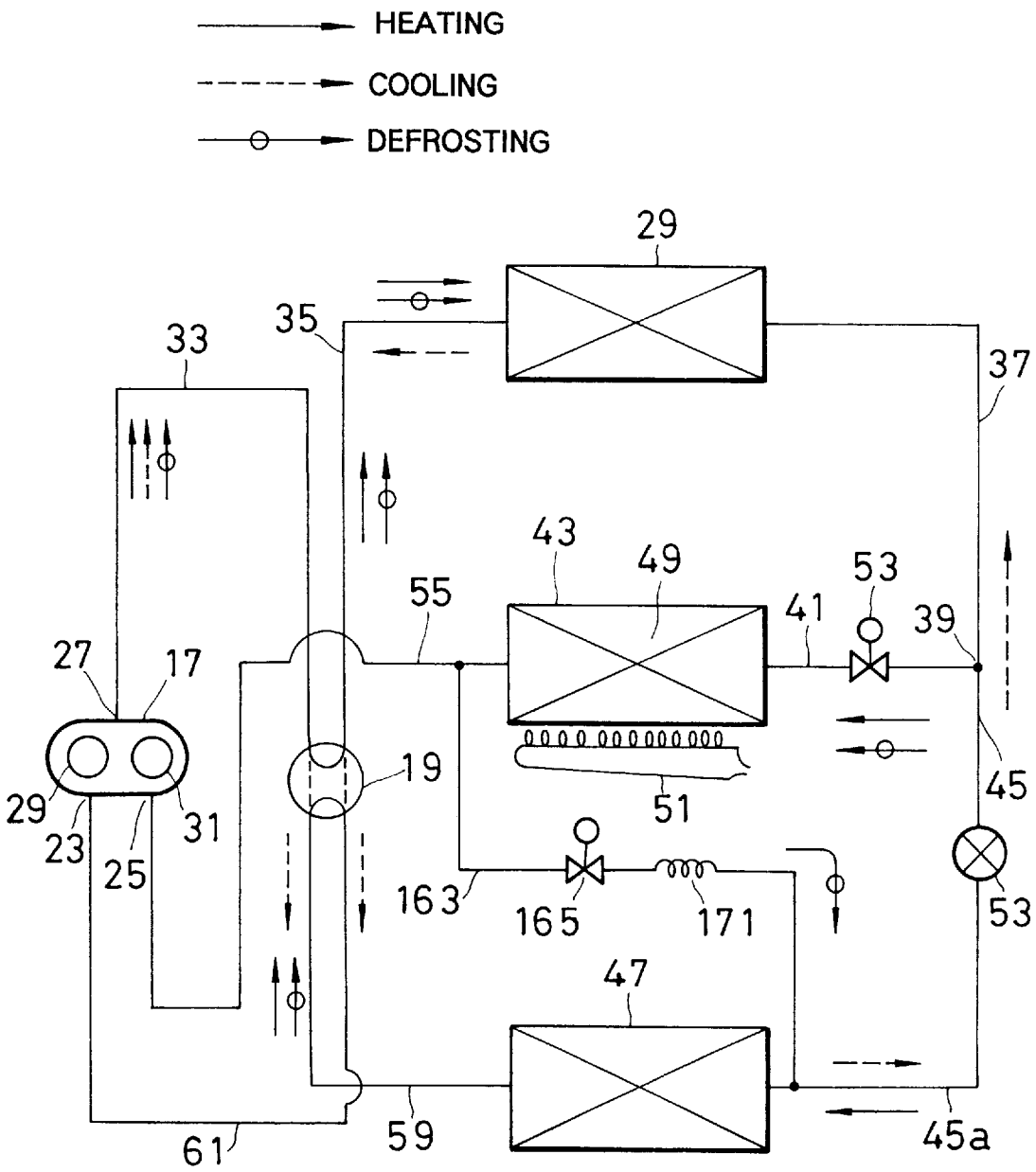
FIG. 20 is a schematic view showing a refrigerating cycle according to a twelfth embodiment of the invention.

FIG. 20 shows the twelfth embodiment of the invention.

This embodiment is characterized by a capillary tube 171 disposed in the piping 163 between the two-way valve 165 and the outdoor heat exchanger 47. The capillary tube 171 serves as a flow resistance member for adjusting the flow rate of the defrosting high-temperature evaporated refrigerant.

Since the capillary tube 171 secures a proper quantity of defrosting evaporated refrigerant, the total quantity of circulated refrigerant can be reduced, the refrigerant can be completely evaporated in the refrigerant heater 43, and a backward flow of refrigerant into the compressor 17 is prevented. The capillary tube 171 may be disposed in the bypass piping 163 between the two-way valve 165 and the refrigerant heater 43.

Figure 21:
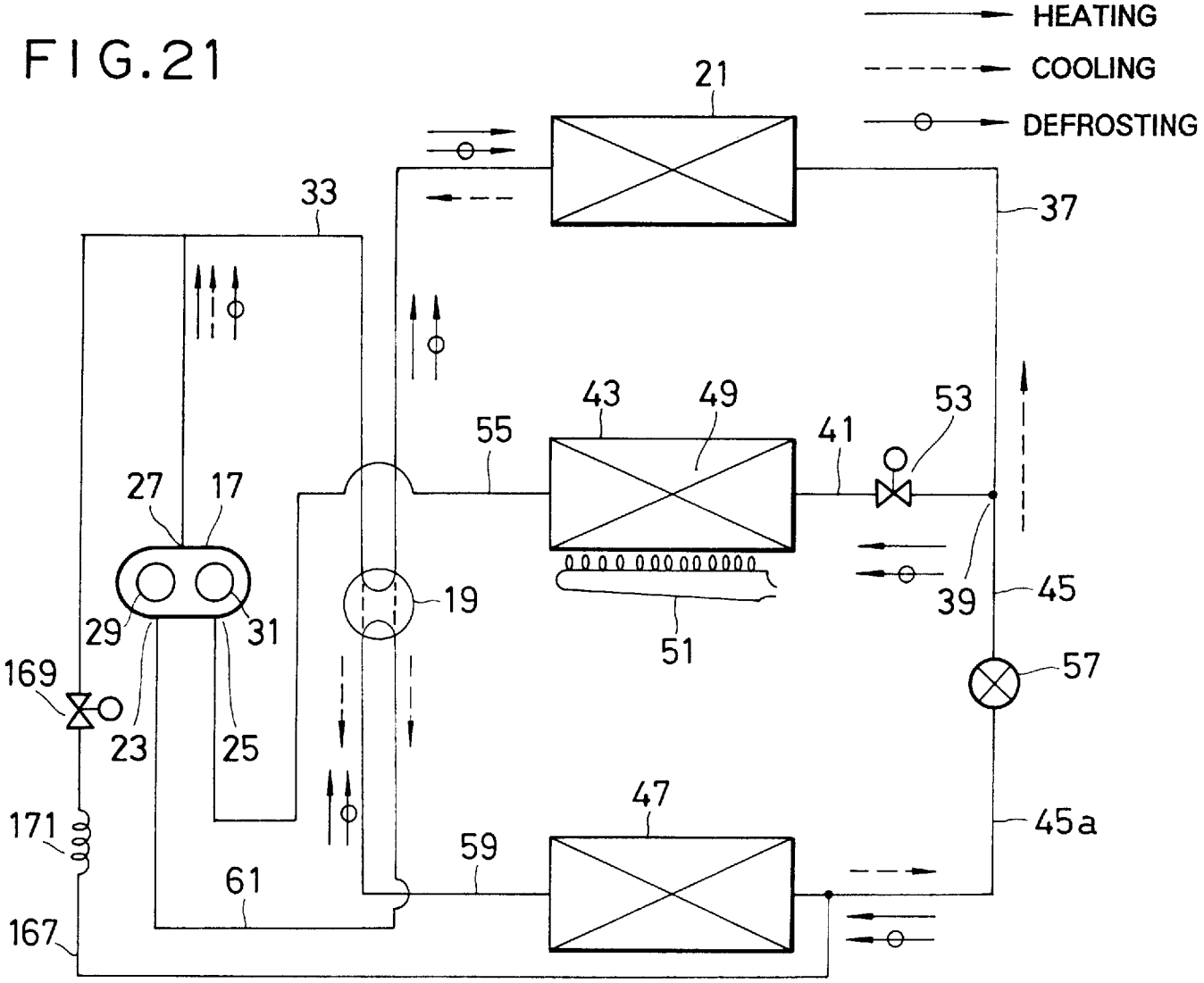
FIG. 21 is a schematic view showing a refrigerating cycle according to a thirteenth embodiment of the invention.

FIG. 21 shows the thirteenth embodiment of the invention.

This embodiment is characterized by a capillary tube 173 serving as a flow resistance member disposed in the bypass piping 167 between the two-way valve 169 and the outdoor heat exchanger 47 of the eleventh embodiment of FIG. 19. The capillary tube 173 secures a proper amount of refrigerant flowing to a heating circuit, i.e., a main circuit during a defrosting operation. As a result, refrigerant exiting from the refrigerant heater 43 may have a proper degree of superheat without decreasing the heating capacity of the refrigerant heater 43, thereby minimizing an influence of the defrosting operation on the main circuit. The capillary tube 173 may be arranged in the bypass piping 167 between the compressor 17 and the two-way valve 169.

Figure 22:
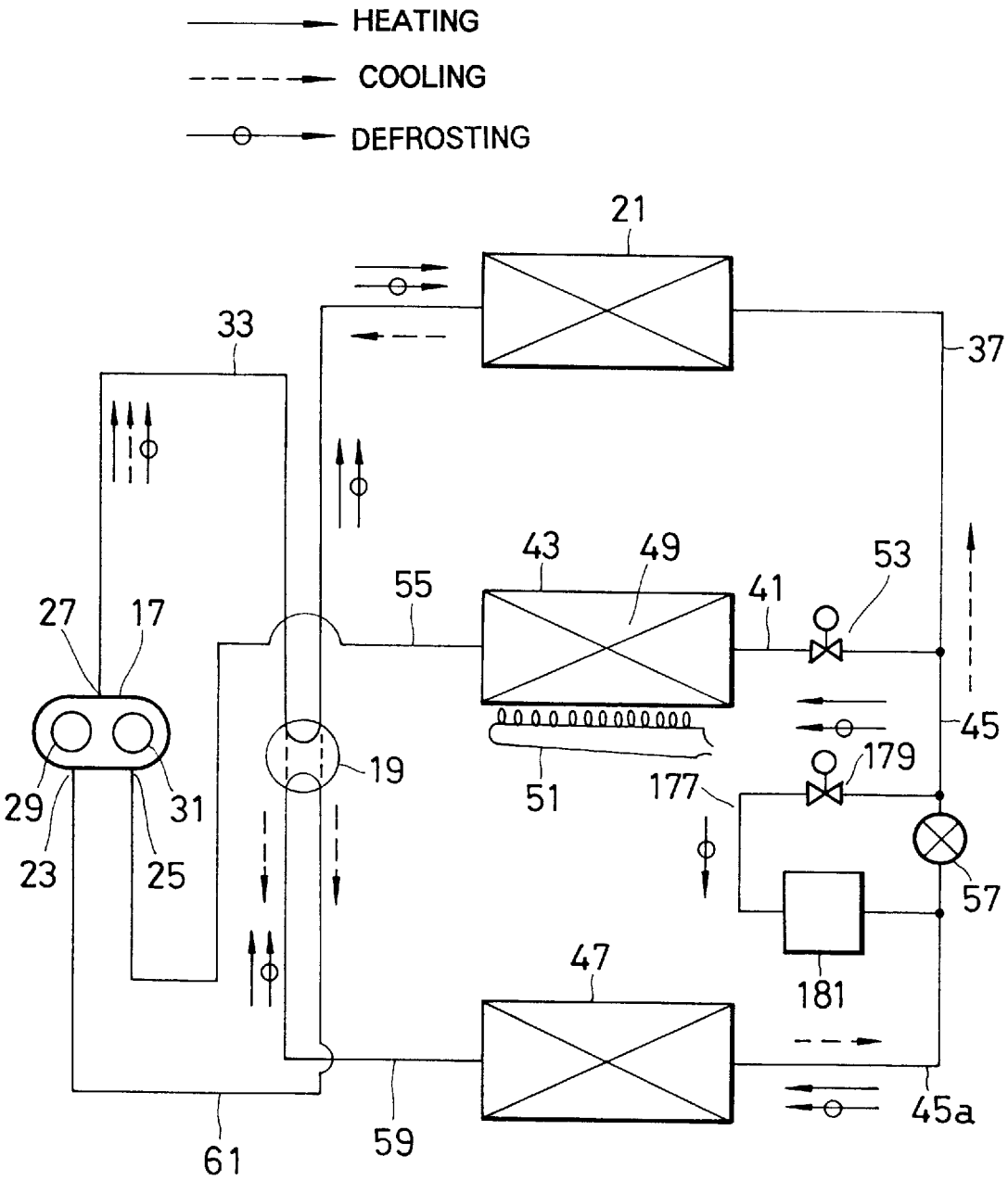
FIG. 22 shows a refrigerating cycle according to a fourteenth embodiment of the invention.

FIG. 22 shows the fourteenth embodiment of the invention.

This embodiment does not have the bypass piping 163 and two-way valve 165 of the tenth embodiment of FIG. 18. Instead, bypass piping 177 for bypassing the expansion valve 57 is arranged. The bypass piping 177 involves a two-way valve 179 as a second open/close valve, and a heat accumulator 181 as heat accumulating means.

When the outdoor heat exchanger 47 is frosted during the simultaneous refrigerant heating and heat pump operations, or during the heat pump operation alone, the two-way valve 179 is opened to guide liquefied refrigerant from the indoor heat exchanger 21 to the heat accumulator 181 through the bypass piping 177. Heat accumulated in the heat accumulator 181 evaporates the liquid refrigerant, and the evaporated refrigerant defrosts the outdoor heat exchanger 47.

Figure 23:
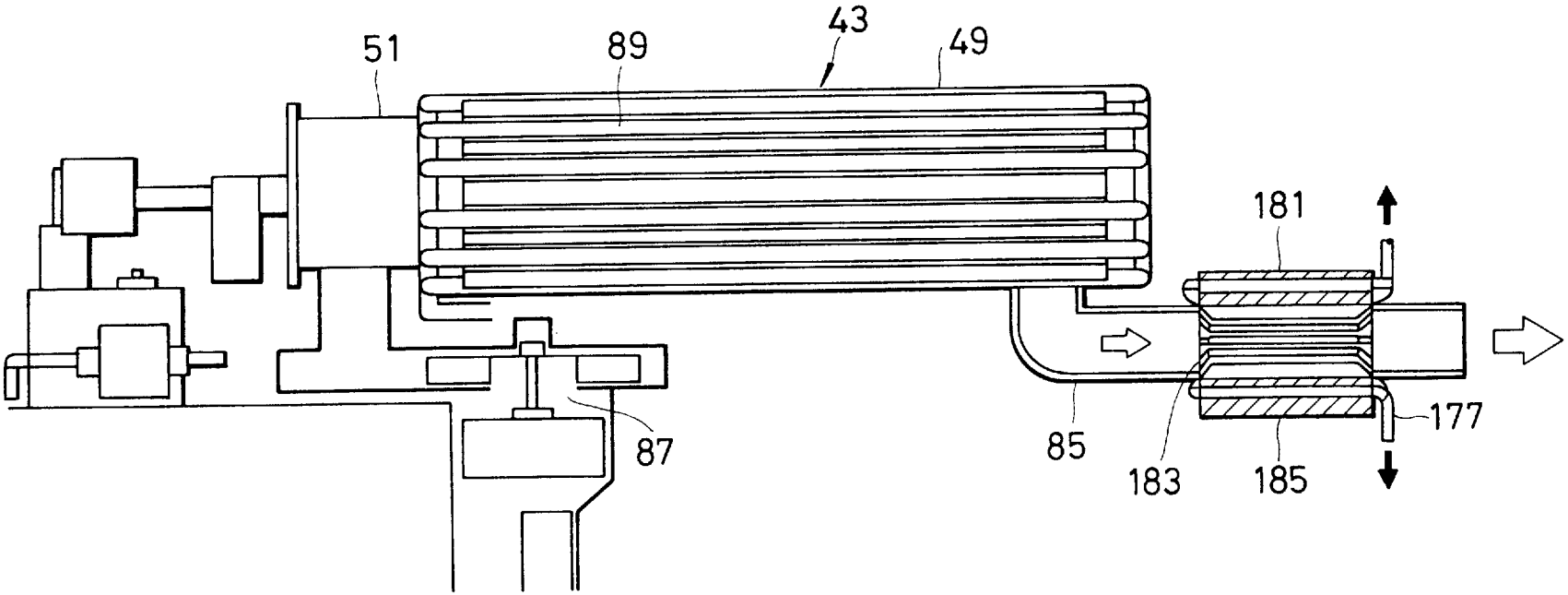
FIG. 23 is a view showing the embodiment of FIG. 22, using an exhaust from a refrigerant heater as a heat source for a heat accumulator.

The heat accumulator 181 accumulates heat by, for example, effectively using a combustion exhaust gas from the refrigerant heater 43, as shown in FIG. 23.

In FIG. 23, the heat accumulator 181 comprises heat transfer fins 183 and heat accumulating material 185 such as paraffin. The heat accumulator 181 is connected to the refrigerant heater 43 through a combustion gas exhaust pipe 85. Numeral 87 denotes a blower for feeding combustion air to the burner 51, and 89 refrigerant piping in the refrigerant heater 43. With this arrangement, the heat accumulator 181 accumulates heat from an exhaust during the operation of the refrigerant heater 43.

Figure 24:
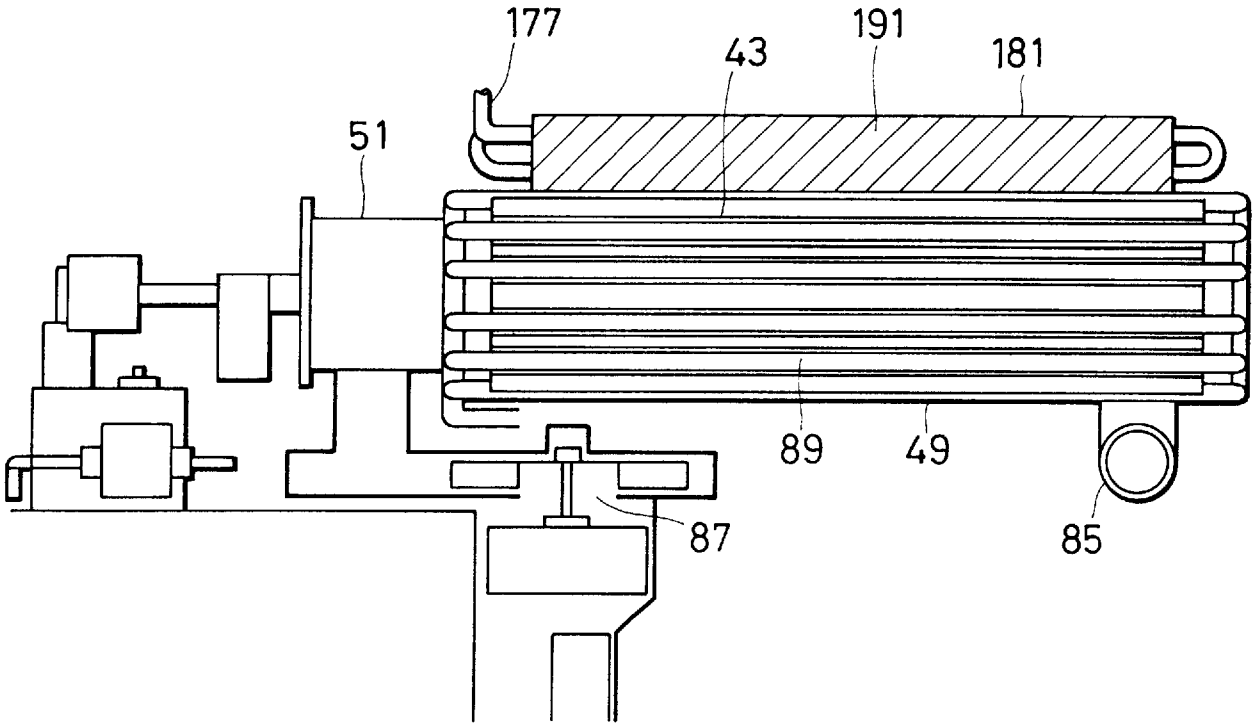
FIG. 24 is a view showing the embodiment of FIG. 22, using a refrigerant heater as a heat source for a heat accumulator.

FIG. 24 shows another heat source for the heat accumulator 181. In the figure, a heat accumulating material 191 is disposed on a wall of the refrigerant heater 43, to use heat radiation from the refrigerant heater 43 as a heat source. Alternatively, a wall of the compressor 17 may be used as a heat source during a heating operation.

As explained above, the invention defrosts the outdoor heat exchanger during a heating operation by opening the second open/close value without operating the directional control valve, and by feeding high-temperature evaporated to the outdoor heat exchanger. Namely, the invention carried out the defrosting operation without stopping the heating operation, thereby providing a user with comfortable air-conditioning.

What is claimed is:

1. An air-conditioning apparatus comprising:

a compressor having two suction ports, a discharge port, and two simultaneously operating cylinders corresponding to the two suction ports;

an indoor heat exchanger;

an outdoor heat exchanger;

a directional control valve for connecting said indoor and outdoor heat exchangers with the discharge port and one of the suction ports of said compressor;

an expansion valve disposed in piping for connecting said indoor heat exchanger with said outdoor heat exchanger;

a refrigerant heater disposed between the piping and the other suction port of said compressor; and an open/close valve disposed between said refrigerant heater and the piping;

wherein, when said refrigerant heater is turned off with said open/close valve being closed and one of said cylinders is driven to carry out a heating operation with a decreased heating capacity, the other of said cylinders is also driven to draw refrigerant downstream of said open/close valve, while said other suction port of said compressor is connected substantially only with said refrigerant heater, to exhaust the refrigerant in said refrigerant heater to form a vacuum condition therein;

wherein, when said refrigerant heater is turned off with said open/close valve being closed and one of said cylinders is driven to carry out a cooling operation, the other of said cylinders is also driven to draw refrigerant downstream of said open/close valve, while said other suction port of said compressor is connected substantially only with said refrigerant heater, to exhaust the refrigerant in said refrigerant heater to form a vacuum condition therein; and wherein said open/close valve comprises a flow control valve.

2. The air-conditioning apparatus as claimed in claim 1, further comprising:

a first temperature sensor disposed in piping on the outlet side of said refrigerant heater, for detecting the temperature of refrigerant;

a second temperature sensor disposed in a heat exchanger of said refrigerant heater, for detecting the evaporation temperature of the refrigerant;

a first controller including a microcomputer for receiving values detected by the first and second temperature sensors, calculating a proper degree of superheat of the refrigerant according to the received values, and adjusting the opening of said flow control valve according to the calculated degree of superheat;

said expansion valve being a second flow control valve;

a third temperature sensor disposed in piping for connecting said outdoor heat exchanger with one of the suction ports of said compressor, for detecting the inlet temperature of the suction port;

a fourth temperature sensor for detecting an evaporation temperature in said outdoor heat exchanger;

a fifth temperature sensor for detecting the temperature of said indoor heat exchanger; and a second controller for receiving values detected by said third, fourth and fifth temperature sensors, calculating the degree of superheat of refrigerant in said outdoor heat exchanger during a heating operation and the degree of superheat of refrigerant in said indoor heat exchanger during a cooling operation according to the temperatures detected by two of the third, fourth, and fifth temperature sensors, and controlling the opening of the second flow control valve according to the calculated degree of superheat.

3. The air-conditioning apparatus as claimed in claim 1, further comprising:

a first temperature sensor disposed in piping on the outlet side of said refrigerant heater, for detecting the temperature of refrigerant;

a second temperature sensor disposed in a heat exchanger of said refrigerant heater, for detecting the evaporation temperature of the refrigerant; and a controller involving a microcomputer for receiving values detected by the temperature sensors, calculating a proper degree of superheat of the refrigerant according to the received values, and adjusting the opening of the flow control valve according to the calculated degree of superheat.

4. An air-conditioning apparatus comprising:

a compressor having two suction ports, a discharge e port, and two simultaneously operating cylinders corresponding to the two suction ports;

an indoor heat exchanger;

an outdoor heat exchanger;

a directional control valve for connecting said indoor and outdoor heat exchangers with the discharge port and one of the suction ports of said compressor;

an expansion valve disposed in piping for connecting said indoor heat exchanger with said outdoor heat exchanger;

a refrigerant heater disposed between the piping and the other suction port of said compressor; and an open/close valve disposed between said refrigerant heater and the piping;

wherein, when said refrigerant heater is turned off with said open/close valve being closed and one of said cylinders is driven to carry out a heating operation with a decreased heating capacity, the other of said cylinders is also driven to draw refrigerant downstream of said open/close valve, while said other suction port of said compressor is connected substantially only with said refrigerant heater, to exhaust the refrigerant in said refrigerant heater to form a vacuum condition therein;

wherein, when said refrigerant heater is turned off with said open/close valve being closed and one of said cylinders is driven to carry out a cooling operation, the other of said cylinders is also driven to draw refrigerant downstream of said open/close valve, while said other suction port of said compressor is connected substantially only with said refrigerant heater, to exhaust the refrigerant in said refrigerant heater to form a vacuum condition therein; and wherein said expansion valve comprises a temperature expansion valve.

5. The air-conditioning apparatus as claimed in claim 4, further comprising:

a temperature sensor and a pressure sensor disposed in piping for connecting said outdoor heat exchanger with one of the suction ports of said compressor; and a controller involving a microcomputer for receiving signals provided by the temperature and pressure sensors, and controlling the opening of the temperature expansion valve such that the degree of heat of refrigerant heated in said outdoor heat exchanger will be constant at the suction port.

6. An air-conditioning apparatus comprising:

a compressor having two suction ports, a discharge port, and two simultaneously operating cylinders corresponding to the two suction ports;

an indoor heat exchanger;

an outdoor heat exchanger;

a directional control valve for-connecting said indoor and outdoor heat exchangers with the discharge port and one of the suction ports of said compressor;

an expansion valve disposed in piping for connecting said indoor heat exchanger with said outdoor heat exchanger;

a refrigerant heater disposed between a part of the piping between said expansion valve and said indoor heat exchanger and the other suction port of said compressor;

an open/close valve disposed between said refrigerant heater and the piping;

a flow control valve disposed between a connection of said open/close valve to the piping and said indoor heat exchanger; and bypassing open/close valve disposed in parallel with said expansion valve;

wherein, when said refrigerant heater is turned off with said open/close valve being closed and one of said cylinders is driven to carry out a heating operation with a decreased heating capacity, the other of said cylinders is also driven to draw refrigerant downstream of said open/close valve, while said other suction port of said compressor is connected substantially only with said refrigerant heater, to exhaust the refrigerant in said refrigerant heater to form a vacuum condition therein; and wherein, when said refrigerant heater is turned off with said open/close valve being closed and one of said cylinders is driven to carry out a cooling operation, the other of said cylinders is also driven to draw refrigerant downstream of said open/close valve, while said other suction port of said compressor is connected substantially only with said refrigerant heater, to exhaust the refrigerant in said refrigerant heater to form a vacuum condition therein.

7. The air-conditioning apparatus as claimed in claim 6, wherein said expansion valve is made of a capillary tube.

8. The air-conditioning apparatus as claimed in claim 7, further comprising:

a first temperature sensor disposed in piping on the outlet side of said refrigerant heater, for detecting the temperature of refrigerant;

a second temperature sensor disposed in a heat exchanger of said refrigerant heater, for detecting the evaporation temperature of the refrigerant; and a controller involving a microcomputer for receiving values detected by the temperature sensors, calculating a proper degree to superheat of the refrigerant according to the received values, and adjusting the opening of said flow control valve according to the calculated degree of superheat.

9. The air-conditioning apparatus as claimed in claim 6, wherein said expansion valve is a temperature expansion valve.

10. The air-conditioning apparatus as claimed in claim 9, further comprising:

a first temperature sensor disposed in piping on the outlet side of said refrigerant heater, for detecting the temperature of refrigerant;

a second temperature sensor disposed in a heat exchanger of said refrigerant heater, for detecting the evaporation temperature of the refrigerant;

a first controller involving a microcomputer for receiving values detected by the temperature sensors, calculating a proper degree of superheat of the refrigerant according to the received values, and adjusting the opening of said flow control valve according to the calculated degree of superheat;

a third temperature sensor and a pressure sensor disposed in piping for connecting said outdoor heat exchanger with one of the suction ports of said compressor; and a second controller involving a microcomputer for receiving signals from said third temperature sensor and pressure sensor, and controlling the opening of the temperature expansion valve such that the degree of heat of refrigerant heated in said outdoor heat exchanger will be constant at the suction port.

11. An air-conditioning apparatus comprising:

a compressor having two suction ports, a discharge port, and two simultaneously operating cylinders corresponding to the two suction ports;

an indoor heat exchanger;

an outdoor heat exchanger;

a directional control value for connecting said indoor and outdoor heat exchangers with the discharge port and one of the suction ports of said compressor;

an expansion valve disposed in piping for connecting said indoor heat exchanger with said outdoor heat exchanger;

a refrigerant heater disposed between the piping and the other suction port of said compressor;

a first open/close valve disposed between said refrigerant heater and the piping; and a second open/close valve disposed between two systems of piping connected to the two suction ports, respectively;

wherein, when said refrigerant heater is turned off with said first open/close valve being closed and one of said cylinders is driven to carry out a heating operation with a decreased heating, capacity, the other of said cylinders is also driven to draw refrigerant downstream of said first open/close valve, while said other suction port of said compressor is connected substantially only with said refrigerant heater, to exhaust the refrigerant in said refrigerant heater to form a vacuum condition therein; and wherein, when said refrigerant heater is turned off with said first open/close valve being closed and one of said cylinders is driven to carry out a cooling operation, the other of said cylinders is also driven to draw refrigerant downstream of said first open/close valve, while said other suction port of said compressor is connected substantially only with said refrigerant heater, to exhaust the refrigerant in said refrigerant heater to form a vacuum condition therein.

12. The air-conditioning apparatus as claimed in claim 11, further comprising:

ambient temperature detecting means for detecting an ambient temperature; and control means for receiving a signal from the ambient temperature detecting means, simultaneously carrying out a refrigerant heating operation and a heat pump operation using said outdoor heat exchanger when the ambient temperature is smaller than a predetermined value, and carrying out only the heat pump operation using said outdoor heat exchanger when the ambient temperature is greater than the predetermined value.

13. The air-conditioning apparatus as claimed in claim 11, wherein each of said first an second open/close valves is a two-way valve.

14. The air-conditioning apparatus as claimed in claim 11, wherein said first open/close valve is a two-way valve, and said second open/close valve is a flow control valve.

15. An air-conditioning apparatus comprising:

a compressor having two suction ports, a discharge port, and two simultaneously operating cylinders corresponding to the two suction ports;

an indoor heat exchanger;

an outdoor heat exchanger;

a directional control valve for connecting said indoor and outdoor heat exchangers with the discharge port and one of the suction ports of said compressor;

an expansion valve disposed in piping for connecting said indoor heat exchanger with said outdoor heat exchanger;

a refrigerant heater disposed between the piping and the other suction port of said compressor;

a first open/close valve disposed between said refrigerant heater and the piping; and a second open/close valve disposed in bypass piping for connecting piping connected to the expansion valve side of said outdoor heat exchanger;

wherein, when said refrigerant heater is turned off with said first open/close valve being closed and one of said cylinders is driven to carry out a heating operation with a decreased heating capacity, the other of said cylinders is also driven to draw refrigerant downstream of said first open/close valve, while said other suction port of said compressor is connected substantially only with said refrigerant heater, to exhaust the refrigerant in said refrigerant heater to form a vacuum condition therein; and wherein, when said refrigerant heater is turned off with said first open/close valve being closed and one of said cylinders is driven to carry out a cooling operation, the other of said cylinders is also driven to draw refrigerant downstream of said first open/close valve, while said other suction port of said compressor is connected substantially only with said refrigerant heater, to exhaust the refrigerant in said refrigerant heater to form a vacuum condition therein.

16. The air-conditioning apparatus as claimed in claim 15, wherein said second open/close valve is a two-way valve.

17. The air-conditioning apparatus as claimed in claim 16, further comprising a capillary tube disposed in said bypass piping in series with the two-way valve.

18. An air-conditioning apparatus comprising:

a compressor having two suction ports, a discharge port, and two simultaneously operating cylinders corresponding to the two suction ports;

an indoor heat exchanger;

an outdoor heat exchanger;

a directional control valve for connecting said indoor and outdoor heat exchangers with the discharge port and one of the suction ports of said compressor;

an expansion valve disposed in piping for connecting said indoor heat exchanger with said outdoor heat exchanger;

a refrigerant heater disposed between the piping and the other suction port of said compressor;

a first open/close valve disposed between said refrigerant heater and the piping; and a second open/close valve disposed in piping for connecting piping connected to the discharge port of said compressor with the piping connected to the expansion valve side of said outdoor heat exchanger;

wherein, when said refrigerant heater is turned off with said first open/close valve being closed and one of said cylinders is driven to carry out a heating operation with a decreased heating capacity, the other of said cylinders is also driven to draw refrigerant downstream of said first open/close valve, while said other suction port of said compressor is connected substantially only with said refrigerant heater, to exhaust the refrigerant in said refrigerant heater to form a vacuum condition therein; and wherein, when said refrigerant heater is turned off with said first open/close valve being closed and one of said cylinders is driven to carry out a cooling operation, the other of said cylinders is also driven to draw refrigerant downstream of said first open/close valve, while said other suction port of said compressor is connected substantially only with said refrigerant heater, to exhaust the refrigerant in said refrigerant heater to form a vacuum condition therein.

19. The air-conditioning apparatus as claimed in claim 18, wherein each of said first and second open/close valve is a two-way valve.

20. The air-conditioning apparatus as claimed in claim 19, further comprising a capillary tube disposed in said bypass piping in series with the two-way valve.

21. An air-conditioning apparatus comprising:

a compressor having two suction ports, a discharge port, and two simultaneously operating cylinders corresponding to the two suction ports;

an indoor heat exchanger;

an outdoor heat exchanger;

a directional control valve for connecting said indoor and outdoor heat exchangers with the discharge port and one of the suction ports of said compressor;

an expansion valve disposed in piping for connecting said indoor heat exchanger with said outdoor heat exchanger;

a refrigerant heater disposed between an intermediate position in the piping between said indoor heat exchanger and said expansion valve and the other suction port of said compressor;

a first open/close valve disposed between said refrigerant heater and the piping; and a second open/close valve and heat accumulating means disposed in bypass piping for bypassing said expansion valve;

wherein, when said refrigerant heater is turned off with said first open/close valve being closed and one of said cylinders is driven to carry out a heating operation with a decreased heating capacity, the other of said cylinders is also driven to draw refrigerant downstream of said first open/close valve, while said other suction port of said compressor is connected substantially only with said refrigerant heater, to exhaust the refrigerant in said refrigerant heater or form a vacuum condition therein; and wherein, when said refrigerant heater is turned off with said first open/close valve being closed and one of said cylinders is driven to carry out cooling operation, the other of said cylinders is also driven to draw refrigerant downstream of said first open/close valve, while said other suction port of said compressor is connected substantially only with said refrigerant heater, to exhaust the refrigerant in said refrigerant heater to form a vacuum condition therein.

22. An air-conditioning apparatus comprising:

a compressor having two suction ports, a discharge port, and two simultaneously operating cylinders corresponding to the two suction ports;

an indoor heat exchanger;

an outdoor heat exchanger;

a directional control valve for connecting said indoor and outdoor heat exchangers with the discharge port and one of the suction ports of said compressor;

an expansion valve disposed in piping for connecting said indoor heat exchanger with said outdoor heat exchanger;

a refrigerant heater disposed between the piping and the other suction port of said compressor; and an open/close valve disposed between said refrigerant heater and the piping;

wherein, when said refrigerant heater is turned off with said open/close valve being closed and one of said cylinders is driven to carry out a heating operation with a decreased heating capacity, the other of said cylinders is also driven to draw refrigerant downstream of said open/close valve, while said other suction port of said compressor is connected substantially only with said refrigerant heater, to exhaust the refrigerant in said refrigerant heater to form a vacuum condition therein; and wherein, when said refrigerant heater is turned off with said open/close valve being closed and one of said cylinders is driven to carry out a cooling operation, the other of said cylinders is also driven to draw refrigerant downstream of said open/close valve, while said other suction port of said compressor is connected substantially only with said refrigerant heater, to exhaust the refrigerant in said refrigerant heater to form a vacuum condition therein.

23. The air-conditioning apparatus as claimed in claim 22, wherein said expansion valve comprises a capillary tube.

24. The air-conditioning apparatus as claimed in claim 22, wherein said open/close valve comprises a two-way valve.

25. An air-conditioning apparatus comprising:

an indoor heat exchanger;

a first cylinder connected to said indoor heat exchanger in order to compress a refrigerant transmitted from said indoor heat exchanger in a cooling mode and to compress the refrigerant to be transmitted to said indoor heat exchanger in a heating mode;

an outdoor heat exchanger connected between said first cylinder and said indoor heat exchanger in order that the refrigerant compressed in and transmitted from said first cylinder radiates heat through said outdoor heat exchanger and is then transmitted to said indoor heat exchanger through an expansion first valve in said cooling mode and that the refrigerant transmitted from said indoor heat exchanger through said expansion first valve absorbs heat through said outdoor heat exchanger and is transmitted to said first cylinder in said heating mode;

valve means, connected to said first cylinder, said indoor heat exchanger and said outdoor heat exchanger, for controlling flow of the refrigerant in accordance with said cooling mode and said heating mode;

a refrigerant heater connected to said indoor heat exchanger in parallel with said outdoor heat exchanger in order to heat the refrigerant transmitted from said indoor heat exchanger through a second valve; and a second cylinder connected between said refrigerant heater and said indoor heat exchanger for causing circulation of the refrigerant by drawing said refrigerant from said refrigerant heater through a suction port of said second cylinder, wherein, when said refrigerant heater is turned off with said second valve being closed and said first cylinder is driven to carry out a heating operation with a decreased heating capacity, said second cylinder is also driven to draw refrigerant downstream of said second valve, while said suction port of said second cylinder is connected substantially only with said refrigerant heater, to exhaust the refrigerant in the refrigerant heater to form a vacuum condition therein; and wherein, when said refrigerant heater is turned off with said second valve being closed and said first cylinder is driven to carry out a cooling operation, said second cylinder is also driven to draw refrigerant downstream of said second valve, while said suction port of said second cylinder is connected substantially only with said refrigerant heater to exhaust the refrigerant in the refrigerant heater to form a vacuum condition therein.

26. The air-conditioning apparatus as claimed in claim 25, wherein said expansion first valve comprises a capillary tube.

27. The air-conditioning apparatus as claimed in claim 25, wherein said second valve comprises a two-way valve.

28. A method of carry out a heating and cooling operation, comprising:

providing an air-conditioning apparatus including a compressor having two suction ports and two simultaneously operating cylinders corresponding to the two suction ports; a refrigerant heater operatively connected by piping to one of said suction ports of said compressor; and an open/close valve disposed within piping operatively connected between said refrigerant heater and the other of said suction ports of said compressor;

driving (A) one of said cylinders to carry out a heating operation with decreased capacity when said refrigerant heater is turned off and said open/close valve is closed, and (B) the other of said cylinders to draw refrigerant downstream of said open/close valve, while said other suction port of said compressor is connected substantially only with said refrigerant heater, to exhaust the refrigerant in said refrigerant heater to form a vacuum condition therein; and driving (C) one of said cylinders to carry out a cooling operation when said refrigerant heater is turned off and said open/close valve is closed, and (D) the other of said cylinders to draw refrigerant downstream of said open/close valve, while said other suction port of said compressor is connected substantially only with said refrigerant heater, to exhaust the refrigerant in said refrigerant heater to form a vacuum condition therein.

29. The method of claim 28, wherein the step of providing further comprises:

arranging a directional control valve in said air conditioning apparatus so that an indoor heat exchanger and an outdoor heat exchanger are connected to a discharge port of said compressor and one of said two suction ports of said compressor; and disposing an expansion valve in piping that connects said indoor heat exchanger and said outdoor heat exchanger.

30. The method of claim 29, wherein the step of providing further comprises providing a two-way valve as said open/close valve.

31. The method of claim 29, wherein said step of disposing further comprises disposing a capillary tube as said expansion valve.

32. The method of claim 29, wherein the step of providing further comprises:

providing a flow control valve as said open/close valve;

disposing a first temperature sensor in piping on an outlet side of said refrigerant heater for detecting the temperature of the refrigerant;

disposing a second temperature sensor in said heat exchanger of said refrigerant heater for detecting the evaporation temperature of said refrigerant; and providing a controller including a microcomputer for receiving values detected by said temperature sensors, calculating a proper of degree of superheat of the refrigerant according to said received values, and adjusting the opening of said flow control valve according to the calculated degree of superheat.

33. The method of claim 29, wherein said step of disposing further comprises:

disposing a temperature expansion valve as said expansion valve;

disposing a temperature sensor and a pressure sensor in piping that connects an outdoor heat exchange of said air conditioner to one of said two suction ports of said compressor; and providing a controller including a microcomputer for receiving values detected by said temperature sensor and said pressure sensor and for controlling the opening of said temperature expansion valve such that the degree of the refrigerant heated in said outdoor heater is constant at the suction port.

34. The method of claim 29, wherein the step of providing further comprises:

disposing said refrigerant heater between a part of said piping between said expansion valve and said indoor heat exchanger and the other suction port of said compressor;

disposing said open/close valve between said refrigerant heater and said part of said piping;

disposing a flow control valve between a connection of said open/close valve to said piping and said indoor heat exchanger; and disposing a bypassing open/close valve in parallel with said expansion valve.

35. The method of claim 34, wherein said step of providing further comprises:

providing a capillary tube as said expansion valve;

disposing a first temperature sensor in piping on an outlet side of said refrigerant heater for detecting the temperature of the refrigerant;

disposing a second temperature sensor in said heat exchanger of said refrigerant heater for detecting the evaporation temperature of said refrigerant; and providing a controller including a microcomputer for receiving values detected by said temperature sensors, calculating a proper of degree of superheat of the refrigerant according to said received values, and adjusting the opening of said flow control valve according to the calculated degree of superheat.

36. The method of claim 34, wherein said step of providing further comprises:

providing a temperature expansion valve as said expansion valve;

disposing a first temperature sensor disposed in piping on an outlet side of said refrigerant heater for detecting the temperature of refrigerant;

disposing a second temperature sensor disposed in a heat exchanger of said refrigerant heater for detecting the evaporation temperature of the refrigerant;

providing a first controller including a microcomputer for receiving values detected by the temperature sensors, calculating a proper degree of superheat of the refrigerant according to the received values, and adjusting the opening of said flow control valve according to the calculated degree of superheat;

disposing a third temperature sensor and a pressure sensor disposed in piping for connecting said outdoor heat exchanger with one of the suction ports of said compressor; and providing a second controller for receiving signals from said third temperature sensor and pressure sensor, and controlling the opening of the temperature expansion valve such that the degree of heat of refrigerant heated in said outdoor heat exchanger is constant at the suction port.

37. The method of claim 29, wherein the step of providing further comprises:

providing a first flow control valve as said open/close valve;

disposing a first temperature sensor in piping on an outlet side of said refrigerant heater for detecting the temperature of refrigerant;

disposing a second temperature sensor in a heat exchanger of said refrigerant heater for detecting the evaporation temperature of the refrigerant;

providing a first controller including a microcomputer for receiving values detected by the first and second temperature sensors, calculating a proper degree of superheat of the refrigerant according to the received values, and adjusting the opening of said first flow control valve according to the calculated degree of superheat;

providing a second flow control valve as said expansion valve;

disposing a third temperature sensor in piping for connecting said outdoor heat exchanger with one of the suction ports of said compressor for detecting the inlet temperature of the suction port;

providing a fourth temperature sensor for detecting an evaporation temperature in said outdoor heat exchanger;

providing a fifth temperature sensor for detecting the temperature of said indoor heat exchanger; and providing a second controller for receiving values detected by said third, fourth and fifth temperature sensors, calculating the degree of superheat of refrigerant in said outdoor heat exchanger during a heating operation and the degree of superheat of refrigerant in said indoor heat exchanger during a cooling operation according to the temperatures detected by two of the third, fourth, and fifth temperature sensors, and controlling the opening of the second flow control valve according to the calculated degree of superheat.

38. The method of claim 29, wherein the step of providing further comprises providing a second open/close valve disposed between two systems of piping connected to the two suction ports, respectively.

39. The method of claim 38, wherein the step of providing further comprises providing a two-way valve for each said open/close valve and said second open/close valve.

40. The method of claim 38, wherein the step of providing further comprises providing a two-way valve for said open/close valve and a flow control valve for said second open/close valve.

41. The method of claim 29, wherein the step of providing further comprises providing a second open/close valve in piping for connecting piping connected to the discharge port of said compressor with piping connected to the expansion valve side of said outdoor heat exchanger.

42. The method of claim 41, wherein the step of providing further comprises providing a capillary tube in said piping in series with said second open/close valve.

43. The method of claim 29, wherein the step of providing further comprises providing a second open/close valve disposed in bypass piping for connecting piping connected to the expansion valve side of said outdoor heat exchanger.

44. The method of claim 43, wherein the step of providing further comprises providing a capillary tube in said piping in series with said second open/close valve.

45. The method of claim 39, wherein the step of providing further comprises providing a second open/close valve and a heat accumulator in bypass piping for bypassing said expansion valve.

46. A method of carrying out a heating and cooling operation, comprising:

providing an air-conditioning apparatus with an indoor heat exchanger;

connecting a first cylinder is said indoor heat exchanger to compress a refrigerant transmitted from said indoor heat exchanger in a cooling mode and to compress the refrigerant to be transmitted to said indoor heat exchanger in a heating mode;

connecting an outdoor heat exchanger between said first cylinder and said indoor heat exchanger in order that the refrigerant compressed in and transmitted from said first cylinder radiates heat through said outdoor heat exchanger and is then transmitted to said indoor heat exchanger through an expansion first valve in said cooling mode and that the refrigerant transmitted from said indoor heat exchanger through said expansion first valve absorbs heat through said outdoor heat exchanger and is transmitted to said first cylinder in said heating mode;

connecting at least one valve to said first cylinder, said indoor heat exchanger and said outdoor heat exchanger, for controlling flow of the refrigerant in accordance with said cooling mode and said heating mode;

connecting a refrigerant heater to said indoor heat exchanger in parallel with said outdoor heat exchanger in order to heat the refrigerant transmitted from said indoor heat exchanger through a second valve; and connecting a second cylinder between said refrigerant heater and said indoor heat exchanger for causing circulation of the refrigerant by drawing said refrigerant from said refrigerant heater through a suction port of said second cylinder, driving (A) one of said cylinders to carry out a heating operating with decreased capacity when said refrigerant heater is turned off and said open/close valve is closed, and (B) said second cylinder to draw refrigerant downstream of said second valve, while said suction port of said second cylinder is connected substantially only with said refrigerant heater, to exhaust the refrigerant in the refrigerant heater to form a vacuum condition therein; and driving (C) one of said cylinders to carry out a cooling operation, when said refrigerant heater is turned off and said second valve is closed, and (D) the other of said cylinder to draw refrigerant downstream of said open/close valve, while said other suction port of said compressor is connected substantially only with said refrigerant heater, to exhaust the refrigerant in the refrigerant heater to form a vacuum condition therein.

* * * * *